United States Patent [19]

Kumano et al.

[11] Patent Number: 4,901,614

[45] Date of Patent: Feb. 20, 1990

[54] KEYBOARD APPARATUS OF ELECTRONIC MUSICAL INSTRUMENT

[75] Inventors: Shinji Kumano; Keisuke Watanabe; Susumu Ohi, all of Hamamatsu, Japan

[73] Assignee: Yamaha Corporation, Hamamatsu, Japan

[21] Appl. No.: 105,188

[22] Filed: Oct. 5, 1987

[30] Foreign Application Priority Data

| | | | |
|---|---|---|---|
| Oct. 6, 1986 | [JP] | Japan | 61-238828 |
| Oct. 20, 1986 | [JP] | Japan | 61-250216 |
| Oct. 20, 1986 | [JP] | Japan | 61-161312[U] |
| Oct. 30, 1986 | [JP] | Japan | 61-260091 |
| Nov. 17, 1986 | [JP] | Japan | 61-273225 |
| Nov. 17, 1986 | [JP] | Japan | 61-273226 |
| Nov. 17, 1986 | [JP] | Japan | 61-273227 |
| Nov. 17, 1986 | [JP] | Japan | 61-273228 |
| Nov. 17, 1986 | [JP] | Japan | 61-273229 |
| Nov. 17, 1986 | [JP] | Japan | 61-273230 |
| Nov. 17, 1986 | [JP] | Japan | 61-176479[U] |
| Nov. 17, 1986 | [JP] | Japan | 61-176480[U] |
| Nov. 18, 1986 | [JP] | Japan | 61-274940 |
| Nov. 18, 1986 | [JP] | Japan | 61-177159[U] |

[51] Int. Cl.[4] ..... G10H 3/00; G10C 3/12; H01H 9/26

[52] U.S. Cl. ..... 84/1.1; 84/DIG. 7; 84/440; 84/433; 200/5 A

[58] Field of Search ..... 84/12.1, DIG. 7, 433–440, 84/448, 430–431, 1.01, 423, 423 A, 423 B; 200/5 A

[56] References Cited

U.S. PATENT DOCUMENTS

| | | | |
|---|---|---|---|
| 2,996,942 | 8/1961 | Jewett | 84/423 X |
| 4,079,651 | 3/1978 | Matsui | 84/DIG. 7 X |
| 4,375,179 | 3/1983 | Schwartz et al. | 84/435 X |
| 4,562,764 | 1/1986 | Marshall | 84/1.1 |
| 4,668,843 | 5/1987 | Watanabe et al. | 84/DIG. 7 X |
| 4,679,477 | 7/1987 | Monte | 84/1.1 |

OTHER PUBLICATIONS

Japanese Utility Model Publication No. Sho 59–21423.
Japanese Patent Laid-Open Specification No. Sho 57–147691.
Japanese Utility Model Laid-Open Specification No. Sho 59–51393.

*Primary Examiner*—A. C. Prescott
*Assistant Examiner*—Matthew S. Smith
*Attorney, Agent, or Firm*—Spensley Horn Jubas & Lubitz

[57] ABSTRACT

A keyboard apparatus of an electronic musical instrument includes keys, mass members, and springs. Each key can pivot about a first pivot fulcrum. Each mass member can pivot about a second pivot fulcrum. Each spring supplies a biasing force to at least the corresponding mass member so that the mass member returns to an initial state. In this apparatus, each key has a point of application for pivoting the corresponding mass member in the same direction as a pivoting direction of each key when each key is depressed.

56 Claims, 19 Drawing Sheets

KEYBOARD APPARATUS OF ELECTRONIC MUSICAL INSTRUMENT

BACKGROUND OF THE INVENTION

The present invention relates to a keyboard apparatus of, e.g., an electronic piano and an electronic organ.

Generally, in a keyboard apparatus of an electronic musical instrument, only a key switch is opened/closed by key operation. Therefore, a performer can produce a musical tone by applying a force to a key, which is a sum of a force required for pivoting the key and a force required for closing the key switch.

On the contrary, in an acoustic musical instrument such as a piano, a hammer (mass member which produces an inertial effect when a key is depressed) for striking strings must be driven upon depression of a key, thereby increasing a load applied upon depression of the key. Therefore, a performer feels key operation heavier than that of the keyboard apparatus of the above electronic musical instrument.

Recently, however, the electronic musical instrument can produce a musical tone similar to that produced by an acoustic piano. For this reason, demand has arisen for a keyboard apparatus providing the same key touch feeling as that obtained by a keyboard of the piano.

A conventional keyboard apparatus of an electronic musical instrument based on the above demand is disclosed in Japanese Patent Laid-Open (Kokai) No. 57-147691. In this apparatus, each key is pivotally disposed about a fulcrum, and a hammer which is formed independently of the key and is associated therewith is pivotally supported about a fulcrum. The hammer is provided to obtain a key touch feeling similar to that obtained by an acoustic piano and has the predetermined mass. The center of gravity of the hammer is located at an end corresponding to a rear end of the key, and a point of application of the hammer for pivoting the hammer in correspondence to pivoting motion of the key is arranged at an end opposite to that of the center of gravity and corresponding to a front end of the key.

Accordingly, when the key is depressed, the hammer is pivoted through the point of application, and when the key is released, the hammer and the key are pivoted clockwise by the weight of the hammer and returned to initial positions. That is, the depressed key is pivoted against the weight of the hammer, thereby obtaining the key touch feeling. In other words, the hammer produces the inertial effect upon depression of the key.

In this keyboard apparatus, however, the fulcrum of the hammer is located at the center of a longitudinal direction thereof. Therefore, upon depression of the key, the hammer is pivoted in a direction opposite to a direction along which the center of gravity thereof is lifted, i.e., a pivoting direction of the key, thereby lowering the position (moving distance) of the center of gravity. This is because the hammer abuts against the key which is moved downward when the center of gravity is lifted to a predetermined position.

As a result, if the weight of the hammer is maintained constant, in order to obtain a desired key touch feeling while assuring the sufficient displacement of the hammer, the height of the keyboard apparatus must be considerably increased. Therefore, an improvement is required to make the keyboard apparatus compact in size.

SUMMARY OF THE INVENTION

It is, therefore, a principal object of the present invention to provide a keyboard apparatus of an electronic musical instrument which can produce a good key touch feeling.

It is another object of the present invention to provide a keyboard apparatus of an electronic musical instrument which can be made compact in size.

It is still another object of the present invention to provide a keyboard apparatus of an electronic musical instrument which can produce a key touch feeling similar to that obtained by a piano, especially, a good dynamic key touch feeling.

It is still another object of the present invention to provide a keyboard apparatus of an electronic musical instrument which can produce a light key touch as a whole while assuring a piano key touch feeling.

In order to achieve the above objects, there is provided a keyboard apparatus of an electronic musical instrument, comprising keys each capable of pivoting about a first pivot fulcrum, mass members each capable of pivoting about a second pivot fulcrum, and springs for supplying biasing forces to at least the mass members so that the mass members return to initial states, wherein each of the keys has a point of application for pivoting a corresponding one of the mass members in the same direction as a pivoting direction of each key when each key is depressed.

DESCRIPTION OF THE PREFERRED EMBODIMENTS

Figure 1:
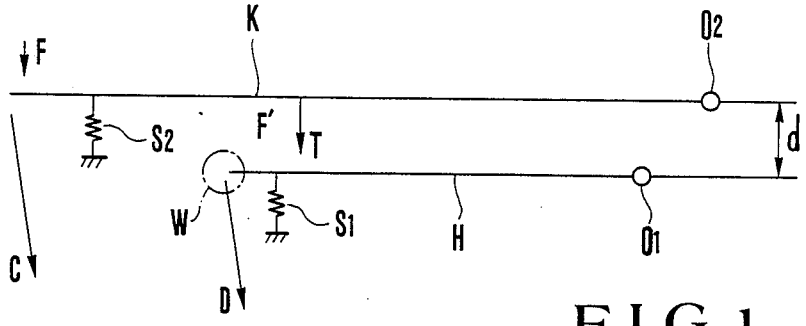
FIG. 1 is a schematic view showing a principle of the present invention.

FIG. 1 shows a principle of the present invention. In a keyboard of FIG. 1, a fulcrum O1 of a hammer (mass member) H is located at the right end of FIG. 1, i.e., below a fulcrum O2 of a key K. When the key K is depressed, a center of gravity W of the hammer H is pivoted in a direction D which is the same direction as a pivoting direction (indicated by an arrow C in FIG. 1) of the key K. That is, when a force F is applied to the key K, the key K pivots about the key fulcrum O2 in the direction C, and at the same time, transmits a force F' to the hammer H at a transmission point T, thereby pivoting the hammer H about the hammer fulcrum O1 in the direction D. When the force F is removed, the hammer H and the key K are returned to their home positions by springs S1 and S2. With this arrangement, a moving distance (position) of the center of gravity W of the hammer H upon depression of a key can be increased, and a distance from the center of gravity W of the hammer H to the fulcrum O1 is increased. As a result, the moving distance of the center of gravity W can be increased by pivoting motion of the hammer H. Therefore, a light piano touch feeling is obtained, the weight of the hammer is reduced, and the height of the keyboard apparatus is reduced. That is, a low-profile compact keyboard apparatus can be obtained.

In FIG. 1, upon depression of a key, the key K and the hammer H are pivoted in the same direction as that (indicated by an arrow) along which the center of gravity W of the hammer H acts. Therefore, in principle, the springs S1 and S2 are required to return the hammer H and the key K, respectively. However, the springs S1 and S2 may be replaced with a single spring as will be described later with reference to the embodiments.

In the above description, the pivot fulcrums of the key K and the hammer H are provided at the ends thereof, respectively. However, it should be noted that similar pivoting motion can be obtained even if the fucrum is not a perfect edge.

A distance d between the key K and the hammer H will be described below. As is apparent from FIG. 1, since the hammer H is pivoted in the same direction as that of the key K, a point where the key K which is pivoting can abut against the hammer H is the hammer fulcrum O1 except for the transmission point T. Therefore, if the hammer fulcrum O1 is provided outside the pivot range of the key K, the key K does not abut against the hammer H except for the transmission point T. Thus, since the distance d between the key K and the hammer H can be arbitrarily set regardless of the pivot range of the hammer H, the distance d can be shorter than that of a conventional apparatus. Therefore, the keyboard apparatus can be low-profile and hence an electronic musical instrument can be made compact.

Note that in this example, the fulcrum O1 of the hammer H is offset from the fulcrum O2 of the key K toward a front side, so that the fulcrum O1 falls outside the pivot range of the key K.

In addition, if a small cavity is formed inside the key K, the key and the hammer can be arranged on a single plane. The following embodiments have this arrangement.

As described above, a key touch feeling similar to that of a piano can be obtained in a narrow space.

Embodiments of the present invention will be described below with reference to the accompanying drawings.

FIGS. 2 to 7 show an embodiment of a keyboard apparatus of an electronic musical instrument according to the present invention.

Figure 2:
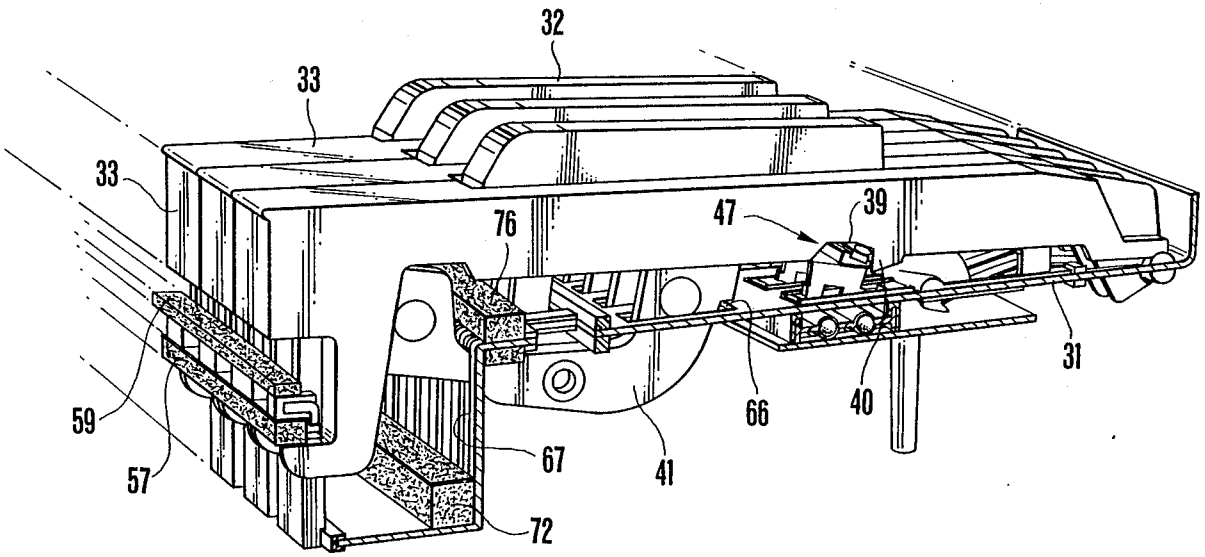
FIG. 2 is a perspective view showing an embodiment of a keyboard apparatus of an electronic musical instrument according to the present invention.
Figure 3:
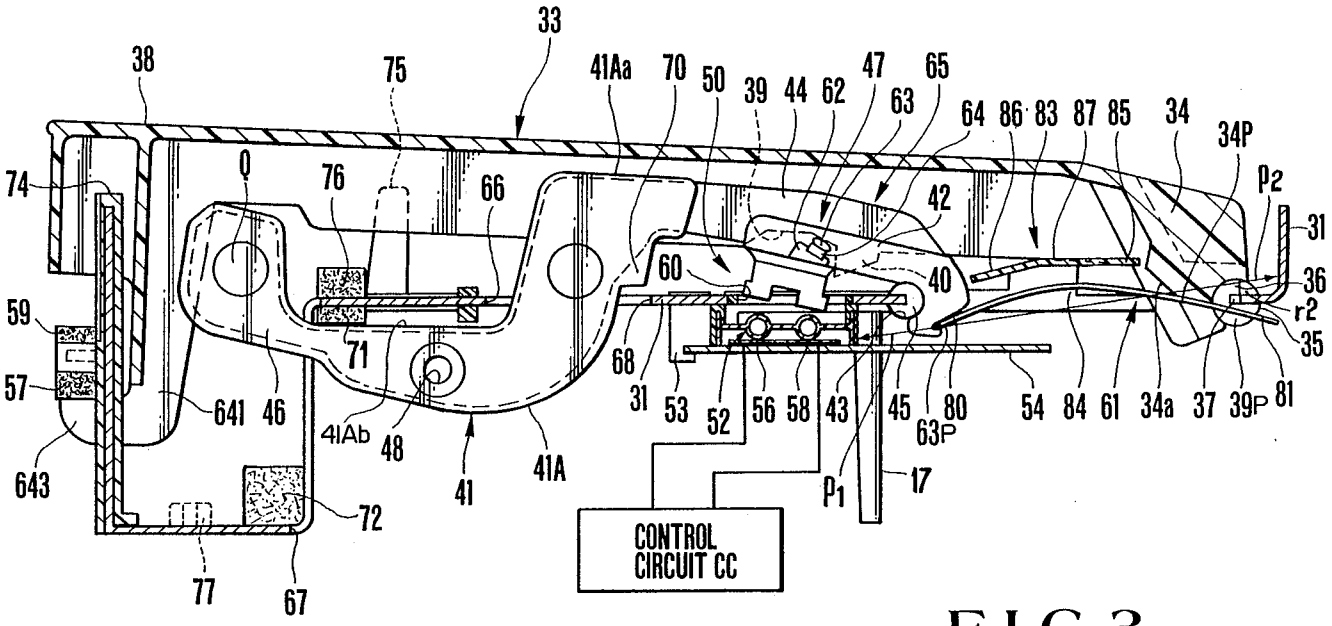
FIG. 3 is a partially cutaway longitudinal sectional view of a white key which is one of keys used in FIG. 1.

In FIGS. 2 and 3, reference numeral 31 denotes a frame of the keyboard apparatus; 33, a key (white key) which is supported on the frame 31 and can be pivoted vertically (vertically in FIG. 3) about its proximal end portion 34; and 32, a black key. The frame 31 is formed of a metal or the like so as to have predetermined rigidity while the key 33 is formed of, e.g., a synthetic resin.

That is, the key 33 engages with a pin 35 having a circular section and fixed to the frame 31 at the proximal end portion 34 (right end portion in FIG. 3: see FIG. 4) (an arcuated recess surface 36 is formed in the proximal end portion 34 and pivotally abuts against the pin 35). Therefore, the key 33 can pivot about the pin (key fulcrum) 35 in a vertical plane. An upper surface of a distal end portion (left end portion in FIG. 3) of the key 33 is a key depression portion 38.

The pin 35 is formed by performing so-called outserting to a peripheral edge of a rectangular slit 37 which is formed in the frame 31. A notched groove having a predetermined width is formed in the pin 35 to extend along an extension direction of the slit 37 (a longitudinal direction of the key 33).

As shown in FIGS. 3 to 7, the key 33 has substantially a box-like shape, and its lower surface is open. A recess portion 39 (hammer drive portion) is formed near a central portion of each side wall of the key 33 at a position.

As shown in FIGS. 3 to 7, a side wall of each recess portion 39 close to the proximal end portion 34 projects downward to form a projection 40.

A hammer 41 is disposed below and along the key 33. As shown in FIG. 2, the hammer 41 is bent to be substantially a crank-like shape. As shown in FIGS. 2 to 7, the hammer 41 is partially inserted in the box-like key 33.

In addition, as shown in FIG. 3, the hammer 41 is pivotally supported in the vertical plane described above about a pin 45 which is fixed to the peripheral edge of the slit 37 at a position opposite to the pin 35 (similar to the pin 35, the pin 45 has a circular section and is formed by outserting). That is, the hammer 41 can pivot vertically in the same vertical plane as that of the key 33 about the pin (fulcrum) 45 (i.e., about a proximal end portion (fulcrum) 42 of the hammer 41). Note that a semicircular engaging surface 43 is formed on a left side surface (FIG. 3) of the proximal end portion 42 and engages with the pin 45 (i.e., biased by a leaf spring to be described later and urged against the pin 45). Therefore, the pin 45 forms a hammer fulcrum.

As shown in FIGS. 2 to 7, the hammer 41 has a core member (hammer frame) 44 which is formed of a predetermined metal so as to have a predetermined weight. Most of a peripheral portion (i.e., backward from a portion slightly separated from the fulcrum) has an edge 41A which is formed of a resin by outserting. The edge 41A includes a guide portion 41A*a* of the hammer 41 at the center thereof and a stopper portion 41A*b* at the front side of the key 33.

The guide portion 41A*a* of the hammer which constitutes part of the edge 41A is formed integrally with the stopper portion 41A*b* by outserting and prevents an increase in resistance caused by friction between the hammer 41 and the frame 31 when the hammer 41 is pivoted. That is, since the fulcrum 45 of the hammer 41 is formed at a lower rear end portion, the proximal end portion 42 of the hammer 41 is pivoted above the upper surface of the frame 31. Upon depression of a key, the hammer 41 is pivoted in the same direction as that of the key. Therefore, in order to minimize the distance between the key and the hammer 41 so as to obtain a low-profile keyboard apparatus, the front end portion of the hammer 41 must be located at a lower surface of the frame 31. For this purpose, in this embodiment, a slit 60 is formed in the frame 31 so that a middle portion of the hammer 41 passes therethrough. Since the width of the slit 60 is larger than that of the hammer 41, the hammer 41 is not brought into contact with the frame 31 as long as it is pivoted along a constant path. However, when the hammer 41 is pivoted, the path of the hammer 41 is not always constant but changes in a widthwise direction thereof due to a vibration and the like. If the hammer 41 is brought into contact with the frame 31 due to such a change in the path, the frame 31 is brought into contact not with the metal body (core member) 44 but with the guide portion 41A*a* formed of a soft resin. Therefore, since a resistance value by friction is small, almost no change is produced in a touch feeling for the key and return characteristics thereof. Accordingly, with the above structure, manufacturing cost of the hammer 41 is reduced, and the touch feeling of the key and the return characteristics thereof are easily set.

The center of gravity of the hammer 41 is located near a distal end portion 46 along the longitudinal direction thereof (i.e., at a left end portion or the front side of the key in FIG. 3). The hammer 41 constitutes a mass member which produces an inertial effect upon depression of a key. Note that reference numeral 48 denotes a through hole formed in the hammer 41 to adjust the center of gravity.

Figure 8:
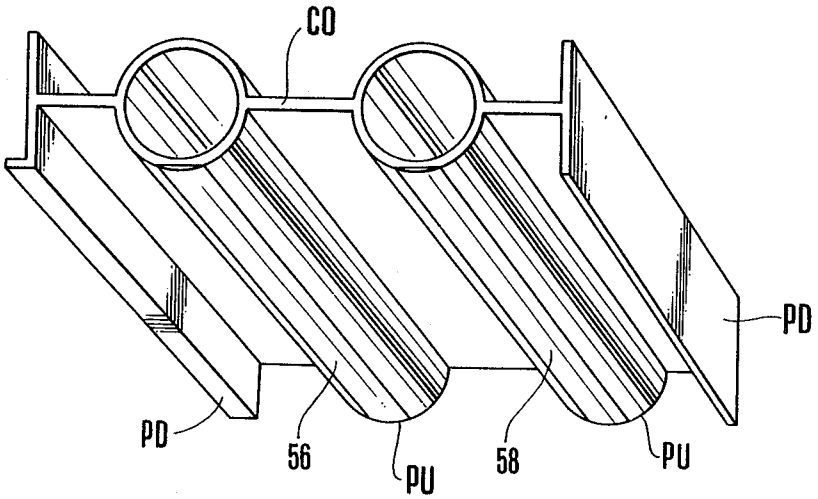
FIG. 8 is an enlarged perspective view of a movable contact of a switch used in FIG. 3.

A single projection or a forked switch drive portion 50 (a forked one in FIG. 3) projects downward near the proximal end portion 42 of the hammer 41. That is, when the hammer 41 is pivoted, the switch drive portion 50 moves downward and abuts against a switch 52. The switch 52 is arranged on a printed circuit board 54 which is held by a holder 53 extending downward from a lower surface of the frame 31. As shown in the enlarged view of FIG. 8, the switch 52 has a pair of conductive rubber switch portions 56 and 58 having a circular section and connected with each other. That is, as shown in FIG. 8, the switch portions 56 and 58 are formed integrally with each other by silicone rubber so as to obtain a pair of urging portions PU each having a circular section, a coupling portion CO for coupling the urging portions PU, and positioning portions PD provided at both sides of the urging portions PU. Conductive rubber members are arranged at lower ends of the respective circular sections to constitute one of contacts, i.e., a movable contact. The conductive members are arranged to oppose a fixed contact on the printed circuit board 54 through a hole of a spacer. Therefore, upon depression of a key, the switch drive portion 50 abuts against the switch 52 through the slit 60 formed in the frame 31, thereby closing (turning on) the switch 52. The switch 52 is of a so-called touch response type and is a so-called 2-make switch in which the two switch portions 56 and 58 are closed at different timings. In this case, by detecting a time difference between the timings, a control circuit CC controls the volume, envelope change, tone color, and the like of a produced musical tone.

An actuator portion 47 horizontally projects above the switch drive portion 50 of the hammer 41 (FIG. 3). When the recess portion 39 of the key 33 abuts against the actuator portion 47, the actuator portion 47 pushes down the hammer 41. That is, a lower surface of the recess portion 39 (hammer drive portion) of the key 33 abuts against the actuator portion 47 of the hammer 41. The actuator portion 47 consists of a resin base portion 62, a resin abutting portion 63, and a rubber vibration damping portion 64 interposed therebetween. The vibration damping portion 64 decreases a shock produced when the key 33 and the hammer 44 strike each other. The right side surface (FIG. 4) of the actuator portion 47 is separated from the projection 40 of the key 33 by a predetermined distance. Therefore, the vibration damping portion 64, the base portion 62, and the abutting portion 63 constitute a member removal preventing portion 65 which abuts against the projection 40 and regulates a movement of the key 33 to the left in FIG. 4.

That is, the member removal preventing portion 65 is provided to the frame 31 through the hammer 41 which is supported by the frame 31, i.e., provided indirectly to the frame 31. Note that the member removal preventing portion 65 may be provided directly to the frame 31.

Figure 4:
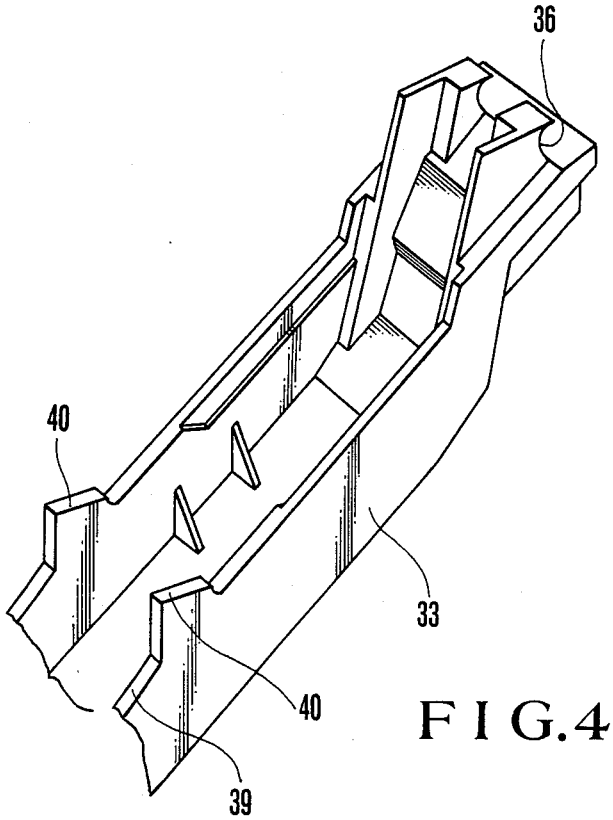
FIG. 4 is a perspective view showing a rear surface of a rear portion of the key shown in FIGS. 2 and 3.

The respective portions of the hammer 41 are loosely fitted in slits 66 and 67 formed in the frame 31, as shown in FIG. 3 and the following figures. That is, a plurality of slits 37, 60, 66, 67 are formed in the frame 31. An abutting portion 70 projecting to the right in FIG. 3 is formed at a portion (subjected to the outserting) of the hammer 41 which is fitted in the slit 66, i.e., a portion which opposes a right peripheral portion 68 (FIG. 3) of the slit 66 upon depression of a key (FIG. 4). As shown in FIG. 3, the abutting portion 70 projects so as to oppose the peripheral portion 68 of the slit 66 at a position separated therefrom by a predetermined distance (small distance) upon depression of a key. That is, the peripheral portion 68 constitutes a regulating portion which abuts against the abutting portion 70 and limits movement (removal) of the hammer 41 to the right.

Note that stoppers or dampers (felts) 71 and 72 for regulating upper and lower limit positions, respectively, of the hammer 41 are fixed in the frame 31. Similarly, stoppers (felts) 57 and 59 for regulating upper and lower limit positions, respectively, of the key 33 are fixed at predetermined positions of the frame 31 in front of the key 33. Reference numerals 74, 75, 76, and 77 denote a guide portion of the white key 33, a guide portion of the black key 32, a lower-limit stopper (felt) for limiting downward movement of a side wall lower end of the black key 32, and a screw hole portion for fixing a musical instrument main body to the frame 31, respectively.

Returning to FIG. 3, reference numeral 61 denotes a rectangular leaf spring made of a metal and having a predetermined modulus of elasticity. One end portion 80 of the leaf spring 61 abuts against and is locked by a locking groove 63p formed in a position closer to an end (opposite to the engaging surface 43) from the hammer fulcrum (pin) 45 of the distal end portion (one end portion) 42 of the hammer 41. The other end portion 81 of the leaf spring 61 having a width smaller than that of the end portion 80 is inserted in a groove 39p which is formed in the pin 35 serving as a fulcrum of pivoting motion of the key 33. An upper surface of the end portion 81 pushes up a lower surface of the end portion (proximal end portion) 34 of the key 33.

Figure 9:
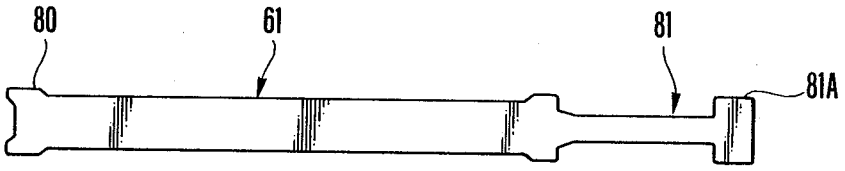
FIG. 9 is a plan view of a leaf spring used in FIG. 3.

That is, as shown in FIG. 9, the leaf spring 61 is disposed such that the end portion 81 having a smaller width is inserted in the groove 39*p* in the pin 35, and the upper surface of the end portion 81 is slidably brought into contact with the lower surface of the proximal end portion 34 so that the recess surface 36 of the proximal end portion 34 is urged against the pin 35. In other words, the end portion 81 of the leaf spring 61 engages with the proximal end portion 34, and the end portion 80 thereof abuts against and is locked by the locking groove 63p. Therefore, when the hammer 41 moves downward upon depression of a key, movement of the leaf spring 61 along the longitudinal direction thereof is limited by a frictional force (i.e., a compression force acts thereon in a buckling direction), so that the leaf spring 61 is elastically deformed (curved) in the thickness direction thereof. As a result, the leaf spring 61 normally biases (gives a return habit to) the hammer 41 clockwise in FIG. 3.

The end portion 81 of the leaf spring 61 extends along the longitudinal direction thereof, and a wide portion 81A which is wider than the groove 39*p* is formed at an extended edge portion of the end portion 81. The wide portion 81A serves as a holding portion for holding the leaf spring 61.

The wide portion (holding portion) 81A abuts against one end wall of the groove 39*p* in which the end portion 81 is inserted, thereby preventing excessive curving deformation of the leaf spring 61. That is, the wide portion 81A and the groove 39*p* limit curving deformation of the leaf spring 61. Therefore, the end portion 81 is not detached from the proximal end portion 34 of the key 33, thereby preventing removal of the leaf spring 61. In addition, since removal of the leaf spring 61 is prevented, the proximal end portion 34 of the key 33 is not disengaged from the pin 35, and the proximal end portion 42 of the hammer 41 is not disengaged from the pin 45. Thus, the wide portion 81A and the groove 39*p* constitute disengagement preventing means.

In this case, contrary to the above embodiment, a locking portion of the leaf spring may be formed in the proximal end portion of the key, and a groove with which the end portion of the spring is engaged is formed in the proximal end portion of the hammer so that the hammer is urged against the hammer fulcrum.

Therefore, the hammer 41 is given a return habit clockwise by a moment of P1·r1 along a direction connecting a position of the locking groove 63*p* with a locking portion 34P of the leaf spring 61 with respect to the key 33, and the key 33 is given the return habit clockwise by a moment of P2·r2 therealong.

All the factors P1, P2, r1, and r2 of the above moment slightly vary as the key 33 and the hammer 41 are pivoted. However, the key 33 and the hammer 41 give the clockwise return habit as a whole as long as $P1 \cdot r1 + P2 \cdot r2 > 0$, and a vector direction thereof is clockwise throughout a time interval from a timing at which a key is not depressed to a timing at which depression of a key is completed.

As shown in FIG. 3 and FIGS. 5 to 7, a stopper member 83 formed by outserting extends from a side wall portion of the slit 37 of the frame 31. The stopper member 83 is disposed above the leaf spring 61 to be separated therefrom by a predetermined interval when a key is not depressed. When the leaf spring 61 is buckled and deformed, the stopper member 83 limits curving deformation of the leaf spring 61 in the thickness direction thereof. That is, by the stopper member 83, the end portion 81 of the leaf spring 61 is not disengaged from the proximal end portion 34 of the key 33, and hence removal of the leaf spring 61 is prevented. Therefore, the proximal end portions 34 and 42 are prevented from being disengaged from the pins 35 and 45, respectively. The stopper member 83 thus constitutes disengagement preventing means. A distance between the stopper member 83 and the leaf spring 61 may be determined on the basis of a distance measured when a key is depressed.

Figure 10:
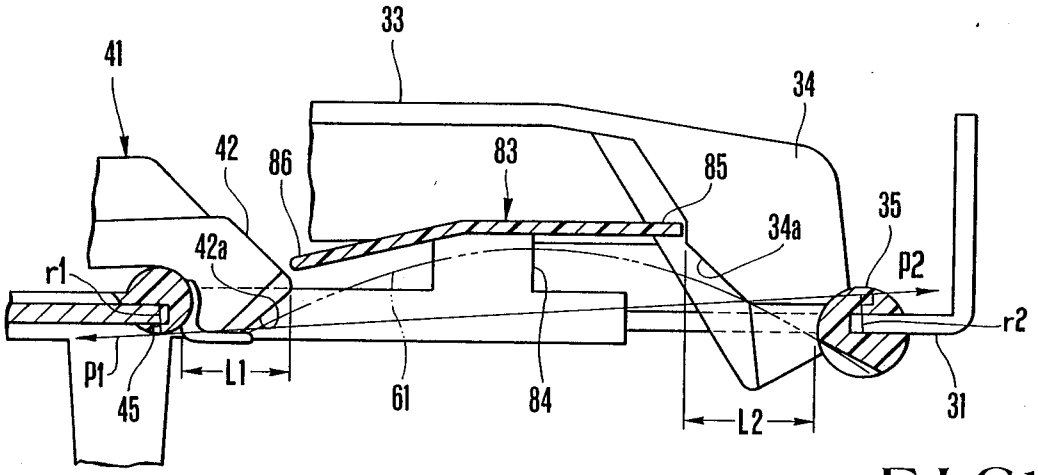
FIG. 10 is a sectional view of main part for explaining assembly of the keyboard apparatus.
Figure 11:
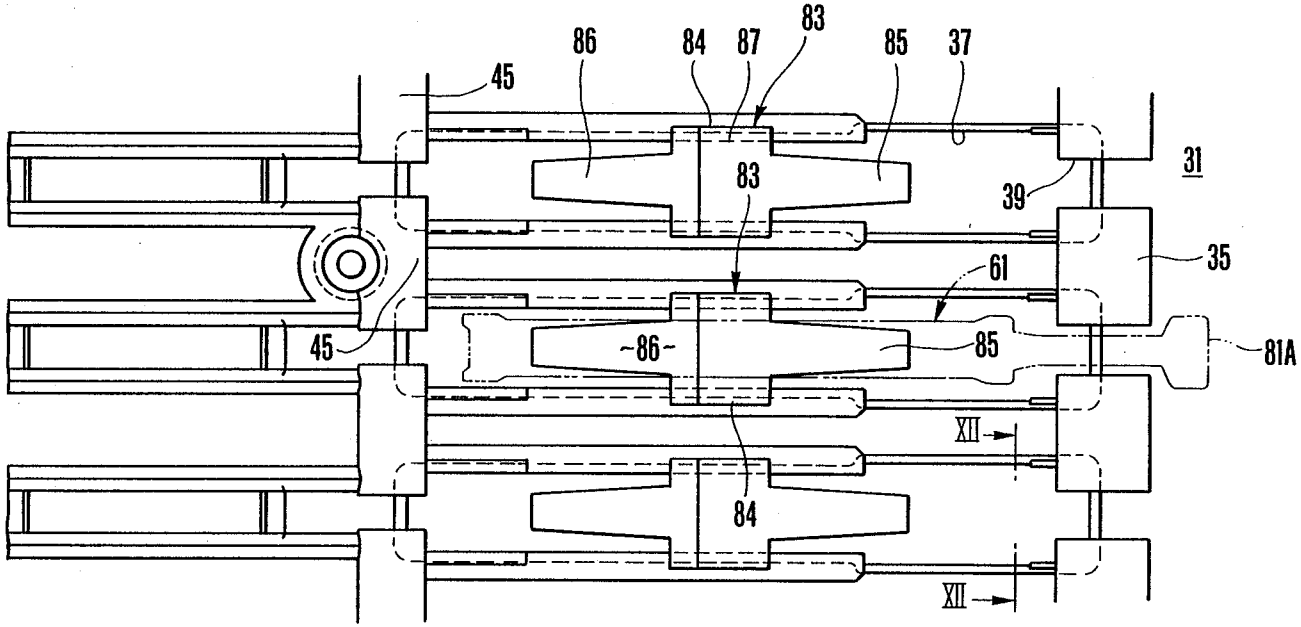
FIG. 11 is a plan view for explaining a frame and a stopper member.
Figure 12:
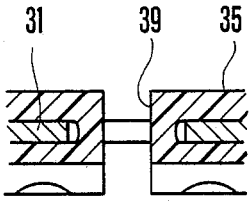
FIG. 12 is a sectional view taken along the line XII—XII of FIG. 11.

As shown in FIGS. 10 and 11 in detail in addition to FIG. 3, the stopper member 83 is a gate-like member across the slit 37 in a widthwise direction thereof. The stopper member 83 has a pair of leg portions 84 extending from the frame 31, a ceiling portion 87 formed across upper end portions of the leg portions 84, a projecting portion 85 which projects horizontally from the ceiling portion 87, and a projecting portion 86 which obliquely projects downward from the ceiling portion 87. When the key 33 and the hammer 41 are assembled to the frame 31, the projecting portions 85 and 86 are locked in the proximal end portions 34 and 42, respectively, thereby preventing removal of the key 33 and the hammer 44. That is, the projecting portions 85 and 86 serve as temporary locking members thereof.

When the leaf spring 61 is curved and deformed upon depression of a key, the stopper member 83 is sometimes largely deformed. In this case, the leaf spring 61 abuts against a lower surface of the stopper member 83 and hence is prevented from being excessively deformed. At this time, the wide portion 81A (FIG. 9) of the leaf spring 61 abuts against one end of the groove 39*p* and prevents deformation of the leaf spring 61. As a result, the key 33 is prevented from being detached from the pin 35, i.e., disengagement of the key 33 is prevented.

At the same time, the end portion 81 of the leaf spring 61 is prevented from being detached from the proximal end of the key 33, thereby preventing removal of the leaf spring 61 and disengagement of the proximal end portion 42 of the hammer 41 from the pin 45. That is, disengagement of the leaf spring 61 is prevented.

Note that even if only one of the disengagement preventing means 86 and 85 is used, the same effect as described above can be obtained.

In addition, according to the present invention, by changing bending rigidity of the leaf spring as needed, the key touch feeling can be arbitrarily set, e.g., hard touch, soft touch, and the like can be freely selected.

An operation of the above keyboard apparatus will be described below.

As shown in FIG. 3, when a key is not depressed, the key 33 and the hammer 41 are returned to the home positions by an elastic force of the leaf spring 61. The actuator portion 47 provided to the hammer 41 does not push down the switch drive portion 50 corresponding to the key 33, thereby turning off the switch 52.

In this state, if a performer depresses the key 33, the key 33 pivots about the key fulcrum 35. Since the lower surface of the recess portion 39 of the key 33 is in contact with the actuator portion 47 of the hammer 41, the biasing force applied to the key 33 is transmitted to the hammer 41. As a result, the hammer 41 pivots about the hammer fulcrum 47. Therefore, since the performer must depress the key 33 to pivot the hammer 41 having a predetermined weight, he or she feels the work required for applying predetermined kinetic energy to the hammer 41 as a key touch feeling. As the hammer 41 is pivoted, the leaf spring 61 is urged and elastically deformed to prepare for release of the key. When the switch drive portion 50 is urged by the hammer 41 upon depression of the key, the switch 52 is turned on. As a result, a musical tone having a pitch corresponding to the key 33 is produced by a predetermined musical tone forming circuit (not shown) through a loudspeaker or the like. When the key 33 reaches the lower limit, the hammer 41 abuts against the stopper 2, and the kinetic energy is damped by elastic deformation of the stopper 72. Thereafter, when the force applied to the key 33 is removed, the key 33 and the hammer 41 are applied with the return characteristic by elastic strain energy stored in the leaf spring 61 and hence are returned to the home positions, and the switch 52 is turned off again.

Note that the preflexed leaf spring 61 is further flexed by buckling deformation caused by pivoting motion of the hammer 41 along with key depression operation and gives a predetermined restoration force to the hammer 41. By slightly increasing a load, flexure of the plate-like leaf spring 61 can be increased. Therefore, a resistive force against the pivoting motion produces a key touch feeling, i.e., a dynamic touch feeling. In this case, even if a deformation amount of the leaf spring 61 is increased by the pivoting motion of the key 33 and the hammer 41, an external force required for this deformation is small. Therefore, although the performer feels the key touch caused by the pivoting motion of the hammer 41, he or she does not feel resistance caused by the elastic force of the leaf spring 61. In this case, the end portion 81 of the leaf spring 61 urges the proximal end portion 34 (36) against the pin 35, and the other end portion 80 thereof urges the proximal end portion 42 (43) against the pint 45.

Since the end portion 81 of the leaf spring 61 is urged against the lower surface of the proximal end portion 34 of the key 33, the end portion 81 is curved and deformed by a predetermined amount. When a deformation amount of the end portion 81 increases, the upper surface of the leaf spring 61 abuts against the lower surfaces of the projecting portions 85 and 86 of the stopper member 83, thereby preventing excessive deformation thereof. Therefore, removal of the key 33 from the pin 35, i.e., disengagement thereof is prevented even if the key 33 is pulled toward the distal end in the longitudinal direction thereof. At the same time, the end portion 81 of the leaf spring 61 is prevented from being removed from the proximal end portion 34 of the key 33. Therefore, removal of the leaf spring 61 and disengagement of the proximal end portion 42 of the hammer 41 from the pin (hammer fulcrum) 45 can be prevented. That is, removal of the key 33 and the hammer 41 can be prevented.

Note that in this case, the key 33 and the hammer 41 have the return habit set by the leaf spring 61. Therefore, when the key 33 is released, the key 33 and the hammer 41 are pivoted in the opposite direction by the biasing force of the leaf spring 61. The key 33 and the hammer 41 abut against the stoppers (felt) 57 and 71 and return to the upper limit positions, respectively.

In the above embodiment, during transportation after the keyboard apparatus is assembled and packed, even if the keyboard apparatus is dropped while longitudinal directions of the key 33 and the hammer 41 are vertically arranged and a large impact force acts along the vertical direction, the key 33 and the hammer 41 are not detached and are kept in an original assembled state. That is, when the key 33 is moved in the longitudinal direction by a predetermined distance due to the impact force, the protection 40 of the key 33 abuts against the rubber vibration damping portion 64 or the side surface (member removal preventing portion 65) of the base portion 62 thereof, thereby limiting excessive movement in the longitudinal direction of the key 33. Similarly, when the hammer 41 moves in the direction along which the hammer 41 is deviated from the hammer fulcrum 45 by a predetermined distance, the abutting portion 70 abuts against the peripheral portion 68 of the slit 66, thereby preventing removal of the hammer 41. Note that in this case, movement (removal) of the key 33 and the hammer 41 in other directions (e.g., a vertical direction in FIG. 2) is prevented by packing materials.

An operation for detaching the key 33 and the hammer 41 after the keyboard apparatus is unpacked will be described with reference to FIGS. 5 to 7.

Figure 5:
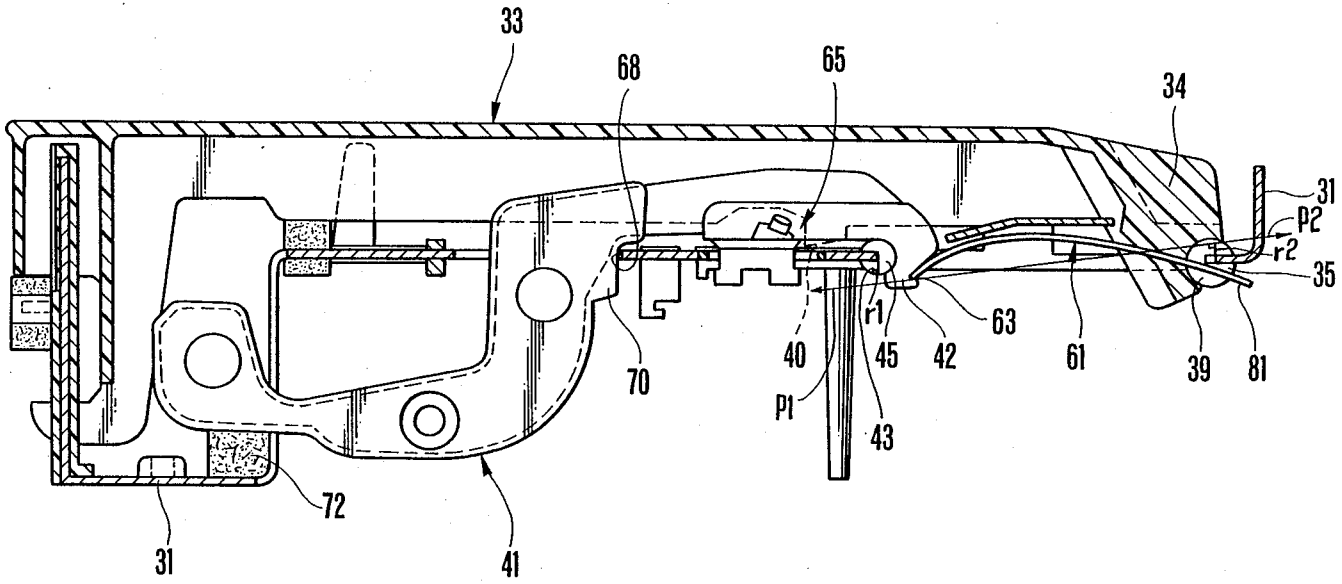
FIG. 5 is a partially cutaway longitudinal sectional view for explaining states of the respective portions obtained when the key is depressed.
Figure 6:
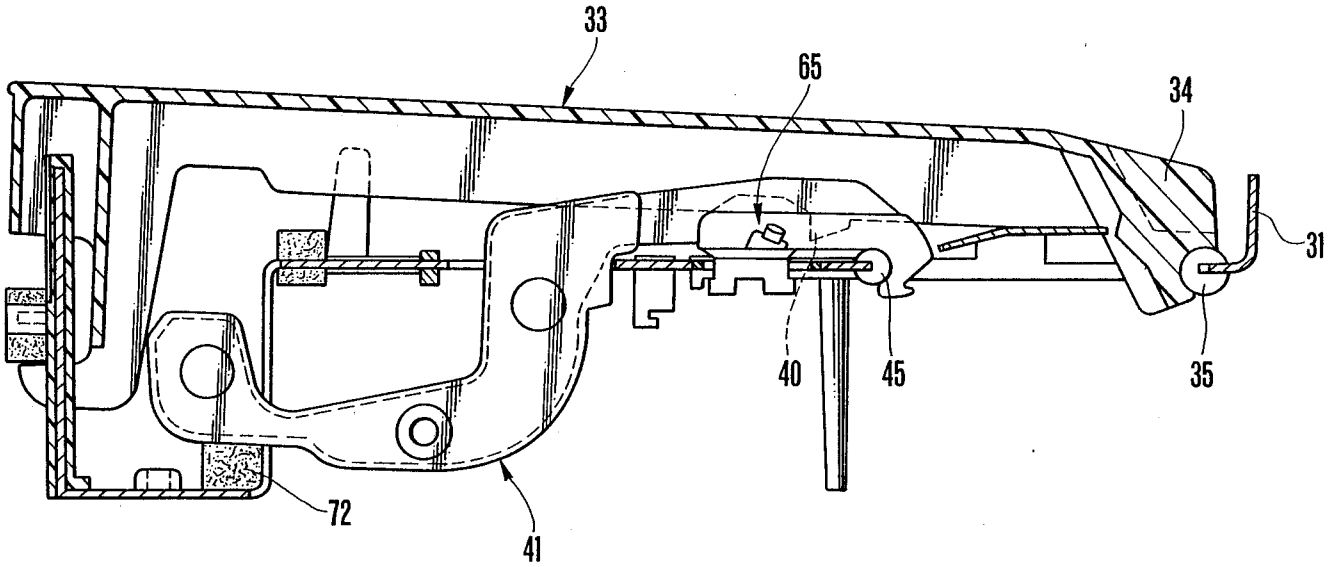
FIGS. 6 and 7 are longitudinal sectional views for explaining state of the respective portions obtained when the keyboard apparatus according to the embodiment of the present invention is exploded.
Figure 7:
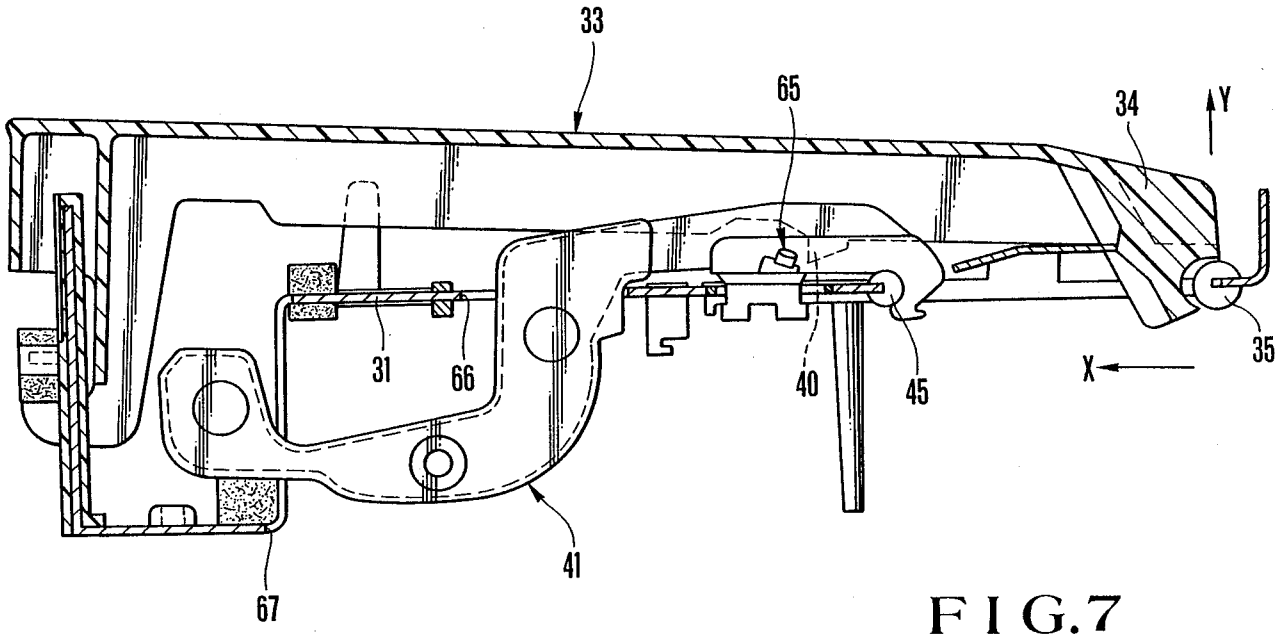

First, as shown in FIG. 5, the key 33 is depressed, and then, as shown in FIG. 6, the leaf spring 61 is pulled out. As a result, the hammer 41 abuts against the stopper 72 by its weight. Thereafter, as shown in FIG. 7, the key 33 is moved in a direction indicated by an arrow X (the projection 40 abuts against the member removal, preventing member 65 and the proximal end portion 34 abuts against the distal end of the projecting portion 85), and then the proximal end portion 34 of the key 33 is lifted in a direction indicated by an arrow Y (in this state, the proximal end portion 34 of the key 33 can be moved only upward). After the key 33 is thus detached, the hammer 41 is pulled out from the slits 66 and 67.

Note that as described above, the projection 40 is constituted by the side wall of the recess portion 39 and the member removal preventing portion 65 is constituted by the actuator portion 47, respectively. Therefore, the above members can be used in common, resulting in easy manufacture and reduction in the number of members.

Assembly of the above keyboard apparatus will be described below with reference to FIG. 10. When the keyboard apparatus is to be assembled, the frame 31 provided with the key fulcrum 35, the hammer fulcrum 45, and the stopper member 83 is prepared by outsertting, and then the hammer 41 is engaged with the hammer fulcrum 45. At this time, a distance between the distal end of the projecting portion 86 having a function of temporarily stopping the hammer and the hammer fulcrum 45 is shorter than a length L1 along the longitudinal direction of the proximal end portion 42 of the hammer 41. Therefore, when the hammer 41 is moved close to the hammer fulcrum 45 from above the frame 31 in FIG. 10, a lower inclined surface 42*a* of the hammer 41 abuts against the stopper member 83. Thereafter, when the hammer 41 is further moved downward in FIG. 10, the stopper member 83 is urged against the hammer 41 and hence is elastically deformed downward in FIG. 10. At the same time, the stopper member 83 increases the distance to the hammer fulcrum 45 so that the proximal end portion 42 of the hammer 41 can pass therethrough. As a result, the hammer 41 engages with the hammer fulcrum 45. After the hammer 41 passes, the stopper member 83 elastically returns. The hammer 41 thus engaged with the hammer fulcrum 45 is not easily disengaged therefrom since the stopper member 83 abuts against an upper inclined surface of the proximal end portion 42 of the hammer 41 when the hammer 41 is to disengage from the hammer fulcrum 5.

After the hammer 41 is engaged with the hammer fulcrum 45 as described above, the key 33 is assembled. That is, the key 33 is moved close to the frame 31 from the same direction as that of the hammer 41. In this case, since a distance between the projecting portion 85 of the stopper member 83 having a function of temporarily stopping the key and the key fulcrum 35 is shorter than a length L2 along the longitudinal direction of the proximal end portion 34 of the key 33, the projecting portion 85 abuts against a lower inclined surface 34*a* of the key 33. When the key 33 is further urged downward, the projecting portion 85 of the stopper member 83 is urged against the key 33 and elastically deformed downward in FIG. 10 so that the key 33 can pass. As a result, the key 33 engages with the key fulcrum 35. After the key 33 passes, the projecting portion 85 is elastically returned. In this case, a small gap is produced between the projecting portion 85 and the key 33 after assembly of the key 33. However, when the key 33 is to be moved forward or upward in FIG. 10, the key 33 abuts against the projecting portion 85 of the stopper member 83 having the temporary key fixing function and hence is not easily removed.

When the key 33 and the hammer 41 are mounted on the frame 31, the frame 31 is turned over, and the leaf spring 61 is mounted between the key 33 and the hammer 41. When the frame 31 is turned over, the key 33 and the hammer 41 tend to be removed from the hammer and key fulcrums 45 and 35, respectively. However, since the projecting portion 86 of the stopper portion 83 having the temporary hammer fixing function and the projecting portion 85 thereof having the temporary key stopping function abut against the hammer 41 and the key 33, respectively, the hammer 41 and the key 33 are not removed respectively from the hammer and key fulcrums 45 and 35. After the leaf spring is mounted between the key 33 and the hammer 41, the key 33 add the hammer 41 are urged against the key and hammer fulcrums 35 and 45, respectively. Therefore, the key 33 and the hammer 41 are operated while maintaining a gap between the projecting portions 85 and 86.

According to the above embodiment, the stopper member 83 is formed independently of the key 33. Therefore, sizes of the respective portions can be independently set, resulting in easy formation of the members. Especially, since the stopper member 83 is formed integrally with the key fulcrum 35 and the like whose size is close to that of the stopper member 83 by outserting, the stopper member 83 can be easily manufactured and disposed in the frame 31.

FIGS. 13 to 16 show a modification of the hammer used in the present invention. Note that the hammer is assembled in the same structure except for the hammer 41 as that of the embodiment shown in FIG. 3.

A hammer 141 of this modification has a metal core member 144. The core member 144 is bent to be a crank-like shape, and substantially a half thereof close to the front portion of the key has a resin edge 144A formed by outserting. The hammer 141 is partially inserted in the box-like key 33 as in the embodiment described above.

The hammer 141 is pivotally supported in the vertical plane about the pin 45 fixed to the frame 31 shown in FIG. 3.

Figure 13:
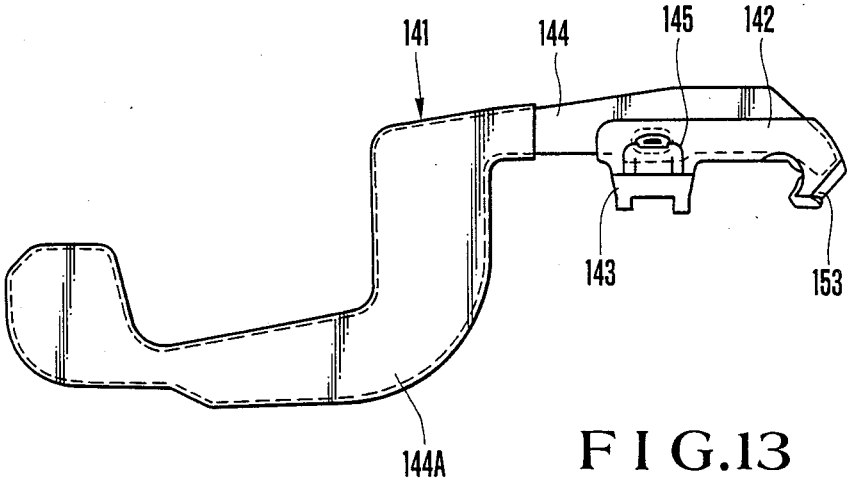
FIGS. 13, 14, 15, and 16 are front, plan, front, and plan views, respectively, of a modification of a hammer.
Figure 14:
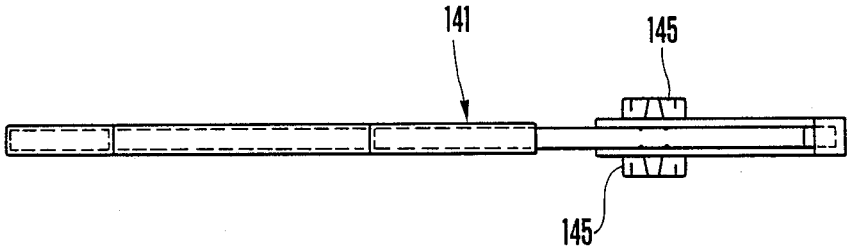
Figure 15:
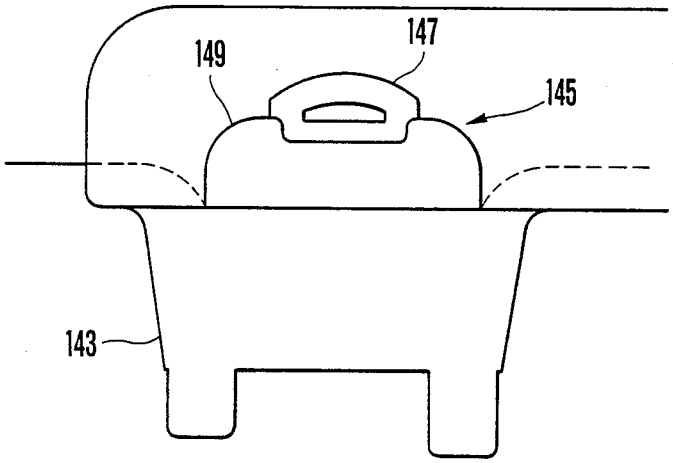
Figure 16:
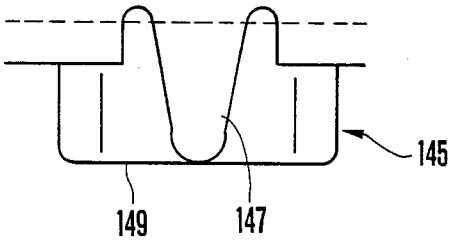

As shown in FIG. 13, a forked switch drive portion 143 projects downward from the hammer 141 at a position close to a fulcrum thereof. An actuator portion 45 projects horizontally above the switch drive portion 43 of the hammer 141. When the recess portion 39 (hammer drive portion) of the key 33 shown in FIG. 3 abuts against the actuator portion 145, the actuator portion 145 pushes the hammer 141 down. As shown in FIGS. 15 and 16, the actuator portion 145 is constituted by a first actuator 147 which is formed of synthetic resin and has a space at a central portion of an elliptic section, and against which the recess portion 39 of the key 33 abuts and a second actuator portion 149 having a substantially elliptic section, located immediately below the first actuator portion 147, for supporting the first actuator portion 147.

Therefore, the actuator portion 145 constitutes a cushion mechanism, provided between the key 33 and an abutting portion of the hammer 141, for damping an impact force produced between the key 33 and the hammer 141. In the cushion mechanism 145, the first actuator 147 is first elastically deformed upon depression of a key, and then the second actuator portion 149 is deformed (the space is collapsed) by a predetermined amount. That is, a modulus of elasticity of the second actuator portion 149 is set larger than that of the first actuator portion 147.

Note that the upper and lower limit positions of the key 33 and the hammer 141 are regulated by a felt member provided as a stopper to the frame 31.

A locking groove 153 is formed in a proximal end portion 142 of the hammer 141. One end of the leaf spring 61 abuts against the locking groove 153 and is locked thereby.

An operation will be described below.

In the keyboard apparatus having the above arrangement, when the key depression portion of the key 33 is depressed downward, the key 33 is vertically pivoted about the proximal end portion thereof, i.e., the pin 35 with which the proximal end portion engages.

Since the lower surface of the recess portion 39 of the key 33 is biased by the leaf spring 61 and abuts against the actuator portion 145 of the hammer 141, the hammer 141 is moved downward along with pivoting motion of the key 33. As a result, the switch drive portion 143 is moved downward to turn on (close) the switch 50. When the switch 50 is turned on, a musical tone having a pitch corresponding to the depressed key 33 is produced by a predetermined musical tone forming circuit (not shown) through a loudspeaker or the like.

In the above key depression operation, when the key is depressed by a walk force, the first actuator portion 147 is elastically deformed within a predetermined range (elastic limit) to transmit the force from the key 33 to the hammer 141 and damps an impact force. In this case, a key touch can be weakened. When the key is depressed with a strong force, the first actuator portion 147 is elastically deformed (the space is further collapsed and elastically deformed) by a predetermined amlunt, and then the second actuator portion 149 is elastically deformed. As a result, plastic deformation of the first actuator portion 147 is prevented, and the impact force is damped by the first and second actuator portions 147 and 149. Therefore, in this case, the key touch can be enhanced.

According to the present invention, both or one of the first and second actuator portions 147 and 149 may be formed by stacking a plurality of elastic members having different moduli of elasticity along a pivoting direction of the key 33. In this case, arbitrary characteristics can be obtained when the impact force is damped. That is, a suitable key touch feeling can be obtained.

Moreover, in the above embodiment, the first and second actuator portions are formed integrally with each other. However, these portions may be formed by a so-called two-color molding method.

With the above arrangement, upon depression of the key, the key partially abuts against the hammer so that the key and the hammer are pivoted at the same time. In this case, the cushion mechanism provided at the abutting portion between the key and the hammer damps an impact force produced by abutment of the key and the hammer. As a result, bouncing of the key or the hammer or generation of mechanical noise (abnormal tone) can be prevented. In this case, at the cushion mechanism, the modulus of elasticity of the first actuator portion is smaller than that of the second actuator portion. For this reason, upon depression of the key, the first actuator portion is elastically deformed and damps the impact force as described above, and then the second actuator portion is elastically deformed after the first actuator portion is elastically deformed by a predetermined amount. As a result, excessive deformation of the first soft actuator portion, i.e., plastic deformation thereof can be prevented. In other words, when the key is normally depressed, the first actuator portion damps the impact force, and when the key is strongly depressed, the second actuator portion damps the impact force and prevents plastic deformation of the first actuator portion. Therefore, a suitable key touch feeling can be obtained in accordance with the key depression force, and at the same time, generation of the mechanical noise can be completely prevented.

FIGS. 17 to 20 show still another modification of the hammer used in the present invention. This hammer is assembled in the structure except for the hammer 41 of the embodiment shown in FIG. 3.

A hammer 241 in this modification has a metal core member 244. The core member 244 is bent to be a crank-like shape, and substantially a half thereof close to the front portion of the key has a resin edge 244A formed by outserting. The hammer 241 is partially, loosely inserted in the box-like key 33.

The hammer 241 is pivotally supported in the vertical plane about the pin 45 fixed to the frame 31.

Figure 17:
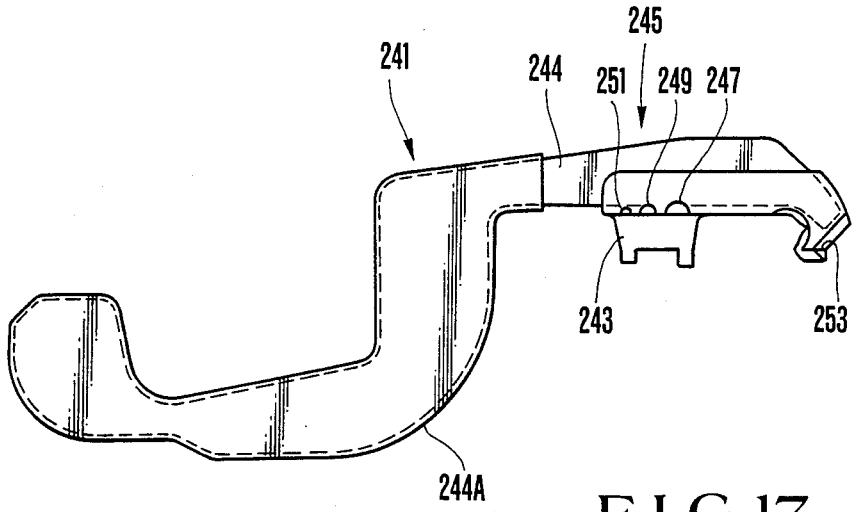
FIGS. 17, 18, 19, 20, and 21 are front views of another modification of the hammer and modifications of the cushion mechanisms.
Figure 18:
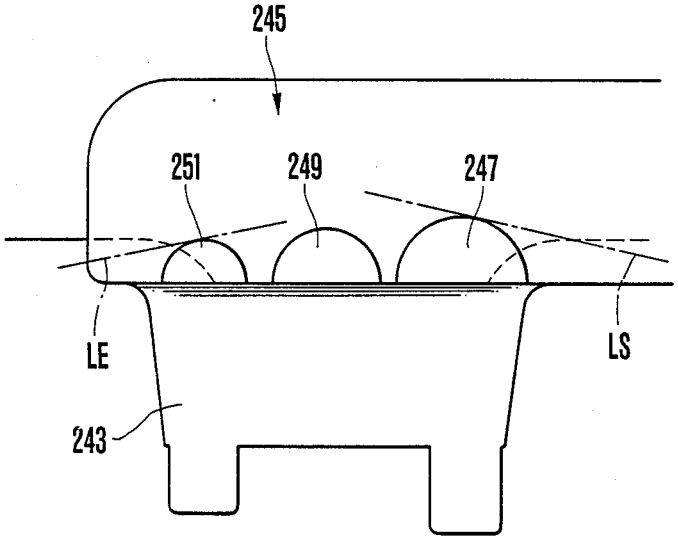

As shown in FIG. 17, a forked switch drive portion 243 projects downward from the hammer 241 at a position close to a fulcrum thereof. An actuator 245 projects horizontally from above the switch drive portion 243 of the hammer 241. When the recess portion 39 (hammer drive portion) of the key 33 abuts against the actuator 245, the actuator 245 pushes down the hammer 241. As shown in FIG. 18, the actuator 245, is constituted by three cantilevered projecting beams 247, 249, and 251 made of synthetic resin and having a semicircular section. As shown in FIG. 18, the projecting beams 247, 249, and 251 are arranged such that radii (i.e., sectional areas) are gradually reduced from the right beam to the left beam in FIG. 18 and the moduli of elasticity are reduced in the order named.

When the key 33 is pivoted, the recess portion 39 of the key 33 sequentially abuts against curved upper surfaces of the projecting beams 247, 249, and 251.

Therefore, the actuator 245 constitutes a cushion mechanism, provided at an abutting portion between the key 33 and the hammer 241, for damping an impact force produced therebetween (accumulating part of a transmission force as elastic energy). In the cushion mechanism 245, upon depression of the key, the projecting beam 247 first abuts against the key 33 and is subjected to elastic deformation and bending deformation, and then the projecting beam 249 is subjected to elastic deformation and bending deformation after the projecting beam 247 is bent by a predetermined amount. Then, the projecting beams 251 is similarly subjected to bending deformation. That is, the modulus of elasticity of the projecting beam 249 is set smaller than that of the projecting beam 247, and the modulus of elasticity of the projecting beam 251 is set smaller than that of the projecting beam 249, respectively. In other words, when the key 33 partially abuts against the cushion mechanism 245 (actuator), high elastic energy is accumulated by the projecting beam 247 first (at an initial stage of key depression), and low elastic energy is finally accumulated by the projecting beam 251 (when key depression is completed). As a result, a desired key touch feeling can be obtained in accordance with the key depression force.

Note that the upper and lower limit positions of the key 33 and the hammer 241 are regulated by the felt member provided as a stopper to the frame 31, respectively.

A locking groove 253 by which one end of the leaf spring 61 is locked is formed in the proximal end portion of the hammer 241.

An operation will be described below.

In the keyboard apparatus having the above arrangement, when the key depression portion of the key 33 is depressed, the key 33 is pivoted about the proximal end portion 34, i.e., the pin 35 with which the proximal end portion 34 engages.

In this case, the lower surface of the recess portion 39 is biased by the leaf spring 61 and abuts against the actuator 245 of the hammer 241. Therefore, as the key 33 is pivoted, the hammer 241 is moved downward. As a result, the switch drive portion 243 is moved downward to turn on (close) the switch. When the switch is turned on, a musical tone having a pitch corresponding to the depressed key 33 is produced by a predetermined musical tone forming circuit (not shown) through a loudspeaker or the like.

In the above key depression operation, when the key is depressed with a weak force at an initial stage of the operation (when the recess portion 39 of the key 33 is set in a state represented by an alternate long and short dashed line LS in FIG. 18), the projecting beam 247 is subjected to elastic deformation and bending deformation (flexure) within a predetermined range, thereby transmitting the force to the hammer 241 and damping an impact force which is part of the transmission force (accumulating the impact force as elastic energy). In this case, a key touch can be weakened (so-called soft touch can be obtained). When the key is depressed with a strong force, the projecting beam 247 is subjected to bending deformation by a predetermined amount, and then the projecting beam 249 is similarly subjected to elastic deformation and bending deformation. Thereafter, as the key 33 is further pivoted, the projecting beam 251 is subjected to bending deformation when key depression is completed (when the recess portion 39 of the key 33 is set in a state represented by an alternate long and dashed line LE in FIG. 18). As a result, part of the transmission force is accumulated as the elastic energy by the actuator 245, and the impact force is damped. Therefore, the key touch is enhanced (so-called hard touch can be obtained).

Figure 19:
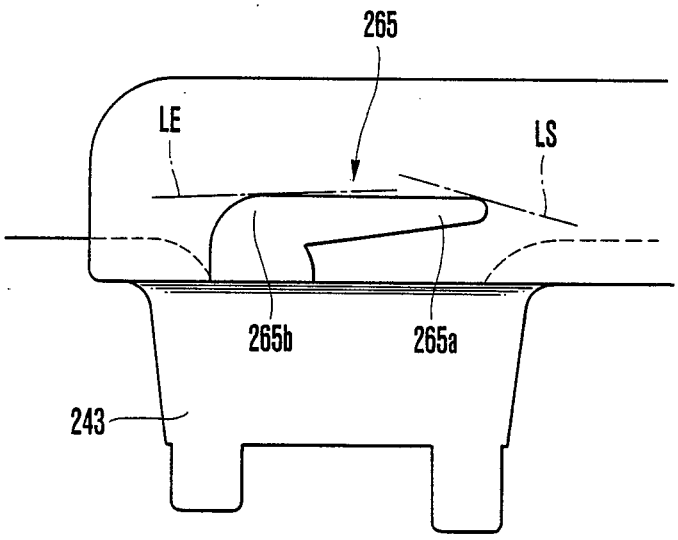

FIG. 19 shows a modification of the cushion mechanism shown in FIG. 18.

In this modification, as shown in FIG. 19, an actuator 265 serving as a cushion mechanism is a cantilever. The cantilever 265 extends along a longitudinal direction of the key. When the key is pivoted, the recess portion 39 of the key abuts against a distal end portion 265*a* of the cantilever 265 so that the cantilever 265 is subjected to bending deformation. As a result, the cantilever 265 accumulates elastic energy. In this embodiment, a sectional area of the cantilever 265 is gradually increased from a distal end to a proximal end (toward the front side of the key). At an initial stage of key depression, the distal end portion 265*a* having a smaller sectional area of the cantilever 265 abuts against part (the recess portion 39) of the key as represented by an alternate long and dashed line LS in FIG. 19. Therefore, a large bending moment acts on the cantilever 265, and an amount of flexure thereof is increased, so that the cantilever 265 accumulates high elastic energy. When key depression is completed, part (the recess portion 39) of the key abuts against a proximal end portion 265*b* of the cantilever 265 as represented by an alternate long and dashed line LE in FIG. 19. Therefore, moment and flexure become smaller than those of the initial stage, so that the cantilever 265 accumulates low elastic energy.

Other arrangements and operations are the same as those of the above modification.

Figure 20:
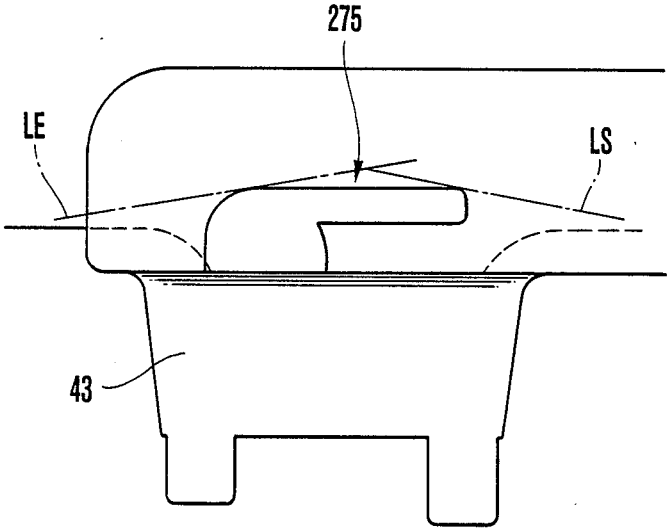

FIG. 20 shows still another modification of the cushion mechanism shown in FIG. 18.

In this modification, an actuator 275 is constituted by a cantilever having a uniform sectional area. Similar to the above embodiment, the elastic energy is accumulated by bending of the cantilever 275. Since the sectional area is uniform, when an abutting portion at which part of the key abuts against the cantilever 275 is moved toward the front side of the key (from LS to LE) as the key is pivoted, bending moment acting on a proximal end portion thereof varies. As a result, an amount of the elastic energy accumulated at an initial stage of key depression differs from that accumulated when key depression is completed.

The other arrangement and operation are the same as those of the above modifications.

With the above arrangement, upon depression of the key, part of the key abuts against the hammer so that the key and the hammer are pivoted at the same time. In this case, a cushion mechanism provided at an abutting portion between the key and the hammer damps an impact force produced by abutment of the key and the hammer (accumulates part of a transmission force as elastic energy). As a result, bouncing of the key or the hammer or generation of mechanical noise (abnormal tone) can be prevented. In this case, at the cushion mechanism, relatively high elastic energy is accumulated at an initial stage of key depression, and elastic energy lower than that accumulated at the initial stage is accumulated when key depression is completed. Therefore, a suitable key touch feeling can be obtained in accordance with a key depression force while completely preventing generation of the mechanical noise.

Figure 21:
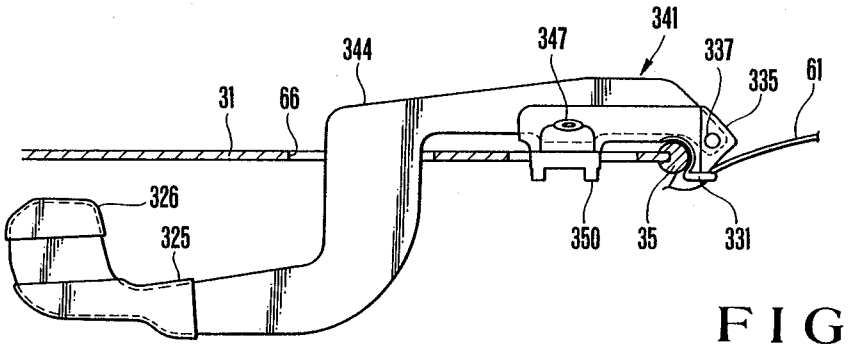

FIG. 21 shows still another embodiment of the hammer. A hammer 341 has a stopper portion 325 which is formed by coating a soft resin material at an intermediate portion of a hook-like metal member 344. An actuator portion 347, a drive portion 350 of a key switch, and a fulcrum portion 331 are integrally formed with each other by the same resin material as that of the stopper portion 325 at a rear end portion of the metal member 344. The actuator portion 347 engages with a key and receives a force transmitted from the key upon depression of the key. When the hammer 341 pivots together with the key upon depression of the key, the drive portion 350 of the key switch closes a key switch circuit provided below the hammer 341 to detect depression of the key. The fulcrum portion 331 is brought into contact with a support shaft 35 provided in a frame 31 and slidably moves thereon to facilitate smooth pivoting motion of the hammer 341. The actuator portion 347, the drive portion 350 of the key switch, and the fulcrum 331 are formed by outserting together with the stopper portion 325. A rear end edge 326 of the metal member 344 may be covered with a resin material as indicated by a broken line in FIG. 21 as needed. Therefore, in order to form the above members, the metal member 344 is placed in molds and then molten resin is injected in the molds, so that a plurality of members having different functions can be formed at the same time and the metal member 344 can be fixed at a predetermined position. As a result, manufacturing cost of the hammer 341 can be reduced, and hence manufacturing cost of the keyboard apparatus using a large number of inexpensive hammers 341 can be greatly reduced. Note that together with the above members, a receiving portion 335 of a leaf spring 61 is fixed at the rear end of the metal member 344 by a screw 337. The leaf spring 61 flexes and gives the hammer 341 and a key 33 the return characteristics when depression of the key is completed. The rear end edge 326 of the metal member 344 serving as a guide portion of the hammer is covered with the resin material by outserting. Therefore, when the hammer 341 is to be inserted in a slit 66 of the frame 31, an insertion guide portion slidably moves on the frame 31 which constitutes the slit 66, thereby facilitating insertion thereof. As described above, since the rear end edge 326 of the metal member 344 is covered with the resin material, not only the manufacturing cost of the hammer 341 can be reduced, but also the keyboard apparatus can be easily assembled.

Figure 22:
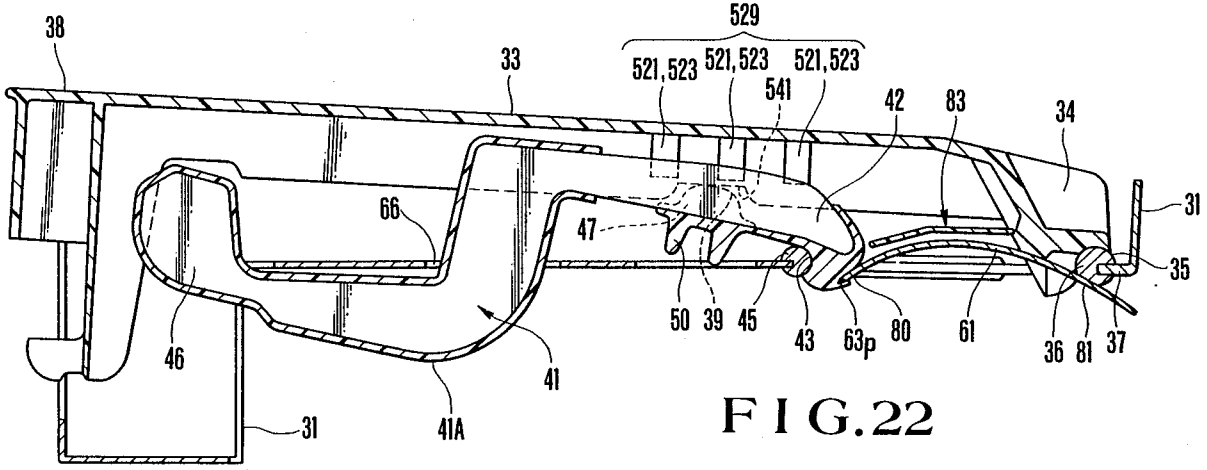
FIGS. 22, 23, and 24 are longitudinal sectional, bottom, and perspective views, respectively, of still another embodiment of the keyboard apparatus.
Figure 23:
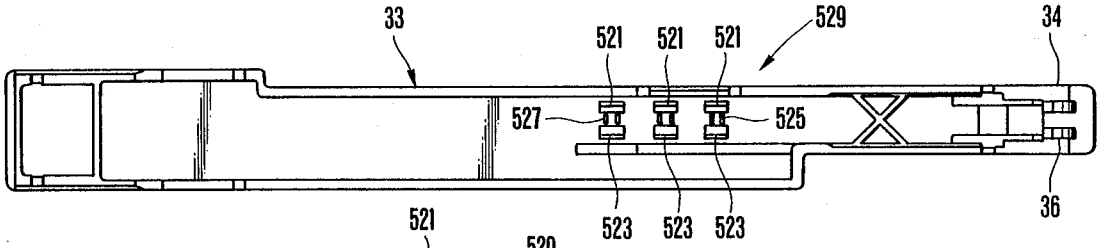
Figure 24:
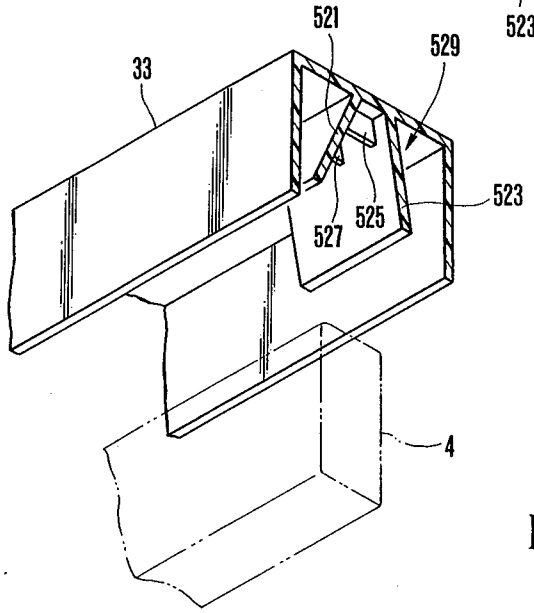

FIGS. 22 to 24 show other embodiments of the present invention in which an impact force produced between the key and the hammer is reduced. The same parts as in the embodiment shown in FIG. 3 denote the same reference numerals in FIGS. 22 to 24.

As shown in FIGS. 22 and 23, a key 33 has substantially a box-like shape, and a lower surface thereof is open. A recess portion 39 is formed in each side wall lower portion of the key 33, and as shown in FIG. 24 in detail, three pairs of projecting pieces 521 and 523, each pair of which form an inverted V-shaped structure, disposed along the longitudinal direction of the key 33. Inner walls of the projecting pieces 521 and 523 are gradually separated from each other, i.e., an interval between the inner walls is gradually increased toward lower portions thereof. The projecting pieces 521 and 523 are formed integrally with the key 33 by, e.g., a synthetic resin material. Small pieces 525 and 527 each having a length shorter than that of each of the projecting pieces 521 and 523 project downward from a lower surface between the projecting pieces 521 and 523.

The hammer 41 is disposed below and along the key 33. As shown in FIG. 22, the hammer 41 is bent to be substantially a crank-like shape. As shown in FIG. 3, the hammer 41 is partially inserted in the box-like key 33, and as shown in FIG. 24, the hammer 41 is inserted between the pair of projecting pieces 521 and 523 to abut against (engage with) the inner walls thereof.

As shown in FIG. 22, the hammer 41 is pivotally supported in the vertical plane about a pin 45 (which has a circular section and is formed by outserting similar to a pin 35) fixed at an edge portion of the slit 37 opposite to the pin 35. That is, the hammer 41 is provided to be pivoted vertically about the pin 45 in the same vertical plane as that of the key 33. Note that the semicircular engaging surface 43 is formed in the left side surface (FIG. 22) of the proximal end portion 42 and engages with the pin 45.

The hammer 41 has a core member which is formed of a predetermined metal so as to have a predetermined weight. Most of an outer surface of the core member has the edge 41A formed of a resin material by outserting. The center of gravity of the hammer 41 is located toward the distal end portion 46 (the left end portion in FIG. 22) along the longitudinal direction thereof.

Therefore, when a rear surface of the hammer 41 partially abuts against the key 33, the three pairs of projecting pieces 521 and 523 constitute a cushion means 529 for reducing an impact force produced between the hammer 41 and the key 33 as a whole.

A forked switch drive portion 50 projects downward from the hammer 41 at a position close to the fulcrum portion 45. That is, when the switch drive portion 50 is moved downward by pivoting motion of the hammer 41, the switch drive portion 50 abuts against a switch disposed on the frame 31 and closes (turns on) it.

An actuator portion 47 projects horizontally from above the switch drive portion 50 of the hammer 41 (FIG. 3). When a recess portion 39 of the key 33 abuts against the actuator portion 47, the actuator portion 47 pushes down the hammer 41. That is, the lower surface of the recess portion 39 of the key 33 abuts against the actuator portion 47 of the hammer 41.

As shown in FIG. 3, the key 33 and the hammer 41 are inserted in the slit 66 formed in the frame 31. That is, a plurality of slits 37 and 66 are formed in the vertical plane of the frame 31, and the key 33 and the hammer 41 are pivoted through the slits 37 and 66.

Note that as shown in FIG. 3, felt members are fixed in the frame 31 to regulate the upper and lower limit positions of the hammer 41. In addition, as shown in FIG. 3, the felt members (stoppers) 57 and 59 for limiting the upper and lower positions of the key 33 are similarly fixed at predetermined positions of the frame 31.

As shown in FIG. 22, reference numeral 61 denotes a rectangular metal leaf spring having a predetermined modulus of elasticity. One end 80 of the leaf spring 61 abuts against and is locked by a locking groove 63p formed in a position closer to an end (opposite to the engaging surface 43) from the fulcrum portion 45 of the proximal end portion 42 of the hammer 41. A width of the other end portion 81 of the leaf spring 61 is smaller than the end portion 80 and the portion 81 is inserted in a groove formed in the pin 35 which is a fulcrum of a pivoting motion of the key 33. An upper surface of the end portion 81 pushes up a lower surface of the end portion 34 of the key 33.

In the keyboard apparatus having the above arrangement, when the front end portion 38 (distal end portion) of the key 33 is pushed downward, the key 33 is pivoted about the proximal end portion 34, i.e., the pin (pivot shaft) 35.

Since the lower surface of the recess portion 39 of the key 33 abuts against the actuator portion 47 of the hammer 41, the hammer 41 is moved downward along with pivoting motion of the key 33. That is, the hammer 41 is pivoted about the pin (fulcrum) 45, and the switch drive portion 50 urges the switch. That is, the switch is turned on, and a musical tone having a pitch corresponding to the depressed key 33 is produced by a predetermined musical tone forming circuit (not shown) through a loudspeaker or the like.

When the key 33 is released, the key 33 and the hammer 41 are pivoted in an opposite direction by a biasing force of the leaf spring 61 since the key 33 and the hammer 41 are given the return characteristics by the leaf spring 61. The key 33 and the hammer 41 abut against the stopper 57 and a stopper 71 and are returned to their upper limit positions, respectively.

In this case, if the key 33 is abruptly released after strong depression, the rear surface of the hammer 41 partially engages with the inner walls of the inverted V-shaped projecting pieces 521 and 523. As a result, the distance between the projecting pieces 521 and 523 is increased (elastically deformed) to damp the impact force. The hammer 41 finally abuts against the small pieces 525 and 527, and the impact force is completely damped. Since the projecting pieces 521 and 523 form the inverted V shape, the hammer 41 can be removed from the inner walls thereof.

When the hammer 41 is pivoted, the abutting portion of the hammer 41 with respect to the key 33 is moved in the longitudinal direction thereof. In this case, the three pairs of projecting pieces 521 and 523 constantly damp the predetermined impact forces, respectively.

Figure 25:
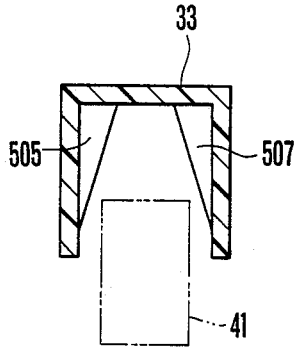
FIG. 25 is a sectional view of a modification of the key relating to FIGS. 22 to 24.
Figure 26:
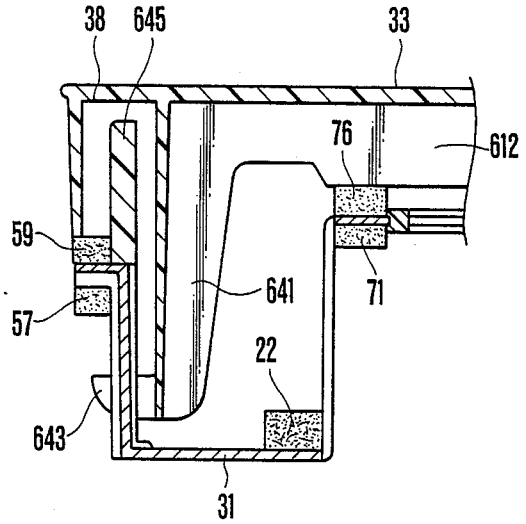
FIGS. 26, 27, 28, and 29 are views of still another embodiment showing a relationship between the key and the frame.

FIG. 25 shows a modification of the embodiments shown in FIGS. 22 to 24. As shown in FIG. 25, projecting pieces 505 and 507 project from side walls of the lower surface of the key 33 to form an inverted V shape. The hammer 41 is partially inserted between the pair of projecting pieces 505 and 507 and engages therewith. In order to facilitate elastic deformation, the projecting pieces 505 and 507 are formed of a material having a modulus of elasticity smaller than that of the key 33. Other arrangements and operations of this modification are the same as those of the above embodiments, and a detailed description thereof will be omitted.

Intervals of a plurality of pairs of the projecting pieces may be reduced step by step to increase a resistive force produced when the hammer strikes them. A shape formed between the above projecting pieces is not limited to a V shape but may be a U shape, and a material which damps the impact force such as a felt material may be adhered thereon.

FIGS. 26 to 29 show still another embodiment of the present invention in which a movement regulating means for regulating movement of the key in a widthwise direction thereof is provided at a front side of the key. The same parts as in FIG. 3 denote the same reference numerals in FIGS. 26 to 29.

Figure 27:
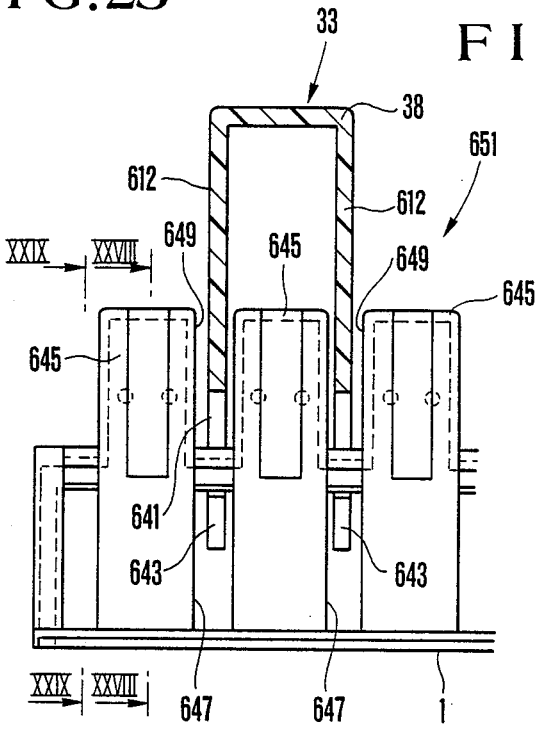

In FIGS. 26 to 29, each side wall 612 partially projects downward from an end portion (key depression portion) 38 at the front side along the longitudinal direction of a key 33. A lower end of this projecting portion 641 is bent to the left in FIG. 3. As shown in FIG. 27, this bent portion 643 is inserted in a slit 647 formed between a plurality of stopper portions 645 having a predetermined width and projecting from a frame 31. Intervals between the stopper portions 645 are minimized in consideration of an assembly error, a manufacturing error, and the like. An upper surface of the bent portion 643 abuts against the stopper (felt) 57, thereby regulating the upper limit position of the key 33 during the pivoting motion.

Figure 28:
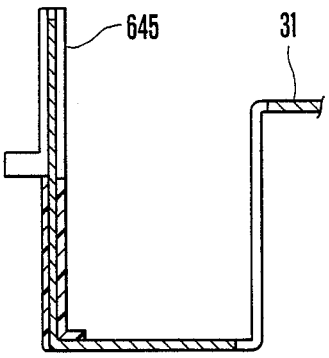
Figure 29:
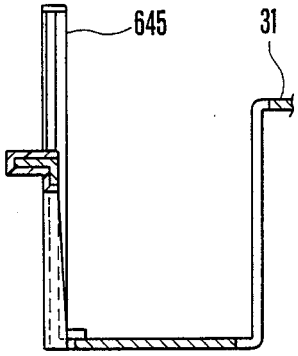

Since the stopper portions 645 project from the frame 31 to be separated from each other by predetermined intervals, grooves 649 having a predetermined width are formed between upper ends thereof. The side walls 612 of the end portion 38 of the key 33 are inserted in the grooves 649 when the key is depressed. That is, the stopper portion 645 is disposed at the end portion 38 along the longitudinal direction of the key 33 to serve as a regulating means 651 for regulating movement along the widthwise direction (transverse direction) of the key 33. In other words, along a vertical pivoting direction of the key 33, inner wall surfaces of the side walls 612 at the upper portion of the key 33 engage with and abut against side wall surfaces of the grooves 649 at the upper portion of the stopper portion 645, and substantially at the same time, the bent portions 643 at the lower portion of the key 33 engage with and abut against inner wall surfaces of the slits 647. Therefore, not only the movement in the widthwise direction of the key 33 but also so-called twisting about an axis of the key 33 in which, for example, the upper portion of the key 33 displaces to the right and the lower portion thereof is displaced to the left, can be prevented. Note that as shown in FIGS. 28 and 29, most of the surface of each stopper portion 645 is covered with a resin material by outserting.

In the keyboard apparatus having the above arrangement, when the end portion 38 of the key 33 is pushed down, the key 33 is pivoted in the vertical plane about one end thereof, i.e., about the pin 35 with which the one end engages.

If a performer does not accurately depress the key depression portion 38 vertically, the key 33 slightly displaces in the widthwise direction thereof. Therefore, the side walls 612 and/or the bent portions 643 of the key 33 abut against the inner wall surfaces respectively of the grooves 649 and/or the slits 647, thereby regulating the movement of the key 33. That is, the key depression portion 38 is pivoted substantially in the vertical plane and hence is not excessively twisted or deviated in the widthwise direction. As a result, damage to a mounting portion of the key 33 caused by excessive twisting and the like can be prevented.

Figure 30:
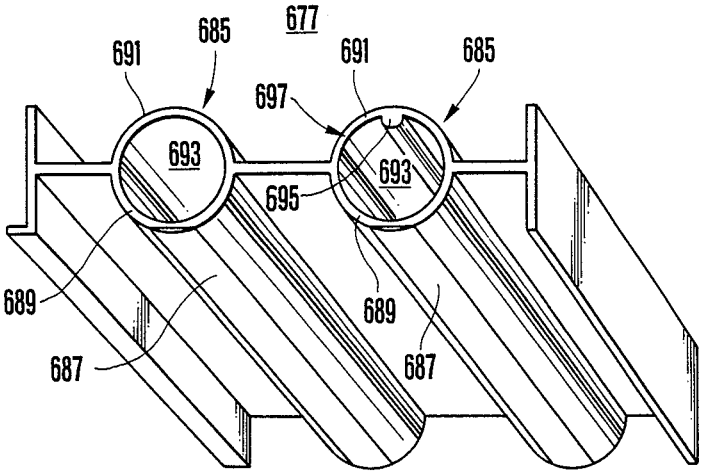
FIGS. 30 to 34 are views of other embodiments of movable contacts of the switches, respectively.
Figure 31:
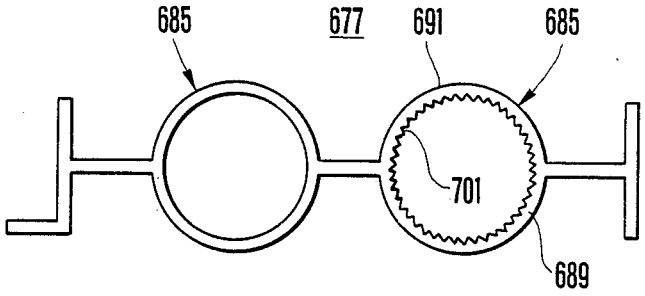

FIGS. 30 and 31 show other embodiments of the present invention in which different structures of the switch 52, especially a movable contact thereof are shown.

In the embodiment of FIG. 30, a movable contact 677 made of silicone rubber is disposed through a spacer. A fixed contact of a predetermined pattern and its peripheral circuit are printed on an upper surface of a printed circuit board. A predetermined window is formed in the spacer so that the fixed contact is exposed upward. A pair of cylindrical portions 685 of the movable contacts 677 are disposed immediately above the window. Legs of the switch drive portion 50 are arranged above the cylindrical portions 685.

The movable contact 677 has band-like conductive portions 687 made of conductive rubber at lower half portions of the pair of cylindrical portions 685, respectively. A lower half of each cylindrical portion 685 constitutes a contact portion 689 which is brought into contact with the fixed contact and closes (turns on) it, and an upper half portion thereof constitutes an urged portion 691 which is urged by the switch drive portion 50 and is brought into tight contact with the contact portion 689, respectively. A circular space is formed between the urged portion 691 and the contact portion 689 which oppose each other.

A band-like projection 695 projects from a lower surface (surface opposite to the contact portion 689) of the urged portion 691 of one of the cylindrical portions 685. The projection 695 constitutes a welding preventing means 697 for preventing welding of the urged portion 691 when the urged portion 691 is brought into tight contact with the contact portion 689.

The switch having the above arrangement will be described below in association with FIG. 3. When the end portion of the key 33 is pushed down, the key 33 is pivoted about its proximal end portion, i.e., about the pin 35 with which the proximal end portion engages.

Since the lower surface of the recess portion of the key 33 is biased by the leaf spring 61 and abuts against the actuator 47 of the hammer 41, the hammer 41 moves downward along with the pivoting motion of the key 33. That is, the hammer 41 is pivoted about the pin (fulcrum) 45, and the switch drive portion 50 abuts against the urged portion 691 of the movable contact 677 and urges it. The urged portion 691 is elastically deformed, and the projection 695 is brought into contact with the opposite surface of the contact portion 689. Therefore, the contact portion 689 is elastically deformed to be brought into contact with the fixed contact and short-circuits it. That is, the switch is turned on.

In this case, the urged portion 691 is not brought into perfect contact with the contact portion 689 because the projection 695 is present. That is, predetermined spaces are formed at both sides of the projection 695, and a contacting surface area is reduced as a whole, thereby preventing welding between the urged portion 691 and the contact portion 689. For this reason, when the key 33 is released, the urged portion 691 instantaneously restores its original shape by a recovering force (elastic force) of the rubber, and substantially at the same time, the contact portion 689 is similarly restored. That is, the response characteristic can be assured when the switch is kept off, and a vibration of the contact portion 689, i.e., a so-called chattering phenomenon which is repetition of ON/OFF can be completely prevented.

Since the movable contact 677 has the pair of cylindrical portions 685, two switches are closed at different timings. Therefore, a difference between the timings is detected to control a volume, an envelope change, a tone color, and the like of a musical tone.

FIG. 31 shows still another embodiment of the present invention.

In this embodiment, a number of small projections 701 having a saw-tooth like sectional shape are formed on an inner surface of the cylindrical portion 685 of the movable contact 677. The projections 701 are projections formed on opposing inner surfaces of both the urged portion 691 and the contact portion 689. When the urged portion 691 is brought into tight contact with the contact portion 689, the projections 701 reduces a contact area and a contact force. Therefore, the projections 701 constitute a welding preventing means.

Figure 32:
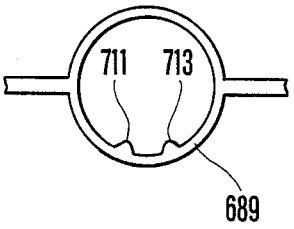

FIG. 32 shows still another embodiment of the present invention.

In this embodiment, two projections 711 and 713 are formed on an inner surface of the contact portion 689. Similar to the above embodiment, these projections 711 and 713 reduce the contact area and the contact force. That is, the projections 711 and 713 constitute a welding preventing means.

Figure 33:
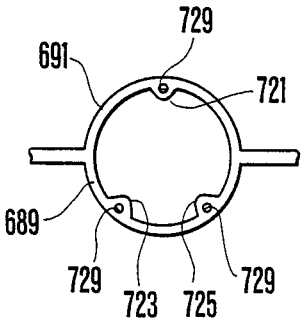
Figure 34:
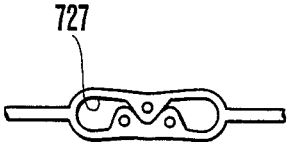

FIGS. 33 and 34 show still another embodiment of the present invention.

According to this embodiment, a projection 721 is formed on an inner surface of the urged portion 691, and two projections 723 and 725 are formed on an inner surface of the contact portion 689. These projections 721, 723, and 725 are arranged offset from each other so that relatively large spaces 727 are formed at both sides upon deformation. Small bubble-like sealed spaces 729 are formed inside the projections 721, 723, and 725, respectively. Therefore, the urged portion 691 and the contact portion 689 are brought into tight contact with each other and deformed, elastic restoration forces of the projections 721, 723, and 725 are further increased. As a result, restoration forces of both the urged portion 691 and the contact portion 689 can be further increased, and welding therebetween can be prevented almost completely. The projections 721, 723, and 725 and the sealed spaces 729 thereof constitute a welding preventing means as a whole.

In the above embodiments, the movable contact is formed to be cylindrical. However, the movable contact may be partially notched.

Note that the welding preventing means is not limited to the projections or the recesses in the above embodiments. For example, at least one of the opposing surfaces of the urged portion and the contact portion may be coated with a low friction material such as TEFLON or the like. That is, welding is prevented by reducing an adhesion force of rubber. It is a matter of course that a nonadhesive material is not limited to a low friction material such as TEFLON but other resin materials or the like may be used. In addition, the above band-like projection may be formed by a material other than rubber, e.g., a metal wire.

It is a matter of course that the present invention is not limited to the above embodiment but various applications and modifications may be made.

Figure 35:
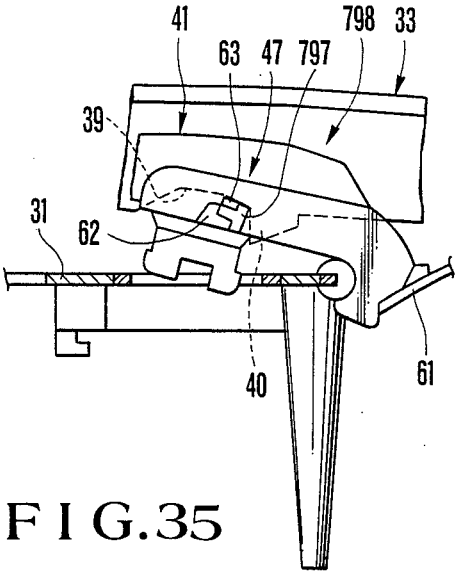
FIGS. 35 to 38 are longitudinal sectional, perspective, longitudinal sectional, and perspective views, respectively, of main parts showing modifications of an engaging portion of the key and the hammer.
Figure 36:
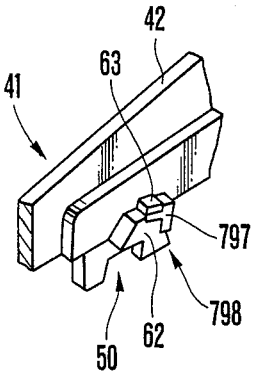

For example, FIGS. 35 and 36 show still another modification of the engaging portion of the present invention. The same parts as in FIG. 3 denote the same reference numerals in FIGS. 35 and 36.

In this embodiment, a rubber vibration damping portion 797 of the actuator portion 47 formed in the hammer 41 is formed such that a right end portion thereof reaches sides of a proximal end portion 62 and an abutting portion 63, i.e., extends vertically. As a result, a member removal preventing portion 798 is constituted by the vibration damping portion 797. Therefore, if a projection of the key 33 abruptly abuts against the member removal preventing portion 798 when it is removed from the fulcrum of the key 33, an impact force can be damped and reduced, thereby preventing a damage to the projection 40 of the key 33 made of a synthetic resin material.

Other arrangements and operations are the same as those of the embodiment shown in FIG. 3.

Figure 37:
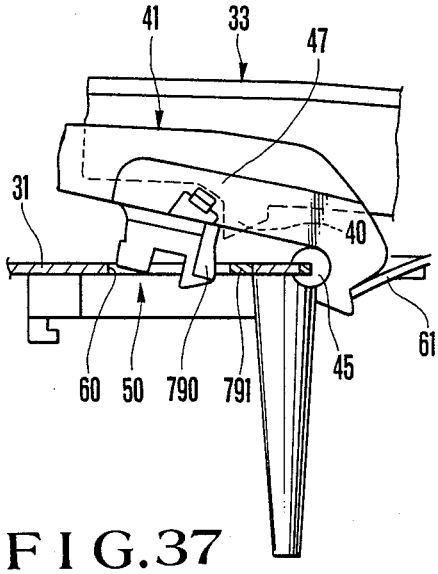
Figure 38:
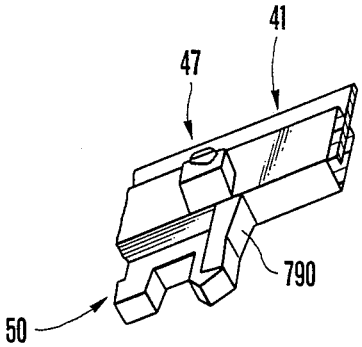

FIGS. 37 and 38 show still another modification of the engaging portion of the present invention. The same parts as in FIG. 3 denote the same reference numerals in FIGS. 37 and 38.

In FIGS. 37 and 38, a side wall at the projection 40 of the switch drive portion 50 of the hammer 41 is formed of resin by outserting to serve as an abutting portion 790. That is, when the hammer 41 moves to the right in FIG. 37 by a predetermined distance, the abutting portion 790 abuts against a peripheral portion 791 to the right of the slit 60 of the frame 31, thereby regulating movement of the hammer 41. Therefore, the peripheral portion 791 constitutes a regulating portion. As a result, in addition to the above effect, the number of members can be reduced since the members can be commonly used.

Other arrangements and operations are the same as those of the above embodiment.

Moreover, in FIG. 3, the hammer 41 can be made smaller by embedding a metal member having larger mass than that of the core metal at a proper position such as Q.

Furthermore, in FIG. 22, the stopper portion is provided vertically along the side walls of the key so as to regulate movement of the key in a transverse direction. However, a guide portion may be extended downward from the key, and stopper members for regulating movement of the key in the transverse direction may be provided at both sides of the guide member.

What is claimed is:

1. A keyboard apparatus for an electronic musical instrument, comprising:

keys each capable of pivoting about a first pivot fulcrum;

mass members each capable of pivoting about a second pivot fulcrum in cooperation with the corresponding key to provide the corresponding key with inertia of the mass member when the corresponding key is depressed; and springs for supplying biasing forces to at least said mass members so that said mass members are biased toward initial states, wherein each of said keys has a point of application for pivoting a corresponding one of said mass members in the same rotational direction as a pivoting direction of said each key when said each key is depressed.

2. An apparatus according to claim 1, wherein the second pivot fulcrum is located closer to the front side of said key than the first pivot fulcrum is.

3. An apparatus according to claim 1, wherein the first and second pivot fulcrums are located on a single plane.

4. An apparatus according to claim 1, wherein the point of application is provided at a side where a center of gravity of said mass member is located with respect to said second pivot fulcrum of said mass member.

5. An apparatus according to claim 1, further comprising a switch drive portion provided in said mass member, a touch response switch provided in association with said switch drive portion, and a control circuit, controlled by an operation of said switch, for controlling production of a musical tone, and wherein when said mass member is pivoted in accordance with a key depression operation of said key, said switch drive portion operates said switch, and said switch controls said control circuit.

6. An apparatus according to claim 5, wherein said switch is a 2-make switch.

7. An apparatus according to claim 5, wherein said switch has a fixed contact fixed on a printed circuit board and a movable member having a movable contact arranged to oppose said fixed contact at a predetermined interval, and said movable member includes an urged portion of a flexible material.

8. An apparatus according to claim 5, wherein said switch has two fixed contacts formed on a printed circuit board and a movable member having a movable contact constituting two switch portions arranged to oppose said fixed contacts at a predetermined interval, and said movable member includes two cylindrical urged portions of a flexible material and a coupling member for coupling said cylindrical urged portions.

9. An apparatus according to claim 8, wherein said switch comprises a 2-make switch which is closed at different timings.

10. An apparatus according to claim 9, wherein welding preventing means is provided in one of said urged portions constituting a switch portion, which is closed first, of said two switch portions.

11. An apparatus according to claim 10, wherein said welding preventing means is a recess or a projection.

12. An apparatus according to claim 1, wherein a cushion mechanism is provided between the point of application of said key and said mass member.

13. An apparatus according to claim 12, wherein said cushion member comprises a first actuator portion which is first elastically deformed upon depression of a key and a second actuator portion elastically deformed after said first actuator portion is deformed by a predetermined amount and having a modulus of elasticity larger than the modulus of elasticity of said first actuator portion.

14. An apparatus according to claim 13, wherein at least one of said first and second actuator portions is constituted by a plurality of elastic members having different moduli of elasticity.

15. An apparatus according to claim 12, wherein said cushion mechanism accumulates, as elastic energy in an initial period of key depression, a predetermined component of a force applied at the point of application from said key to said mass member and accumulates, as elastic energy during a later period of key depression and/or after key depression, force applied from said key to said mass member smaller than the force applied in the initial period of key depression.

16. An apparatus according to claim 15, wherein said cushion mechanism comprises an actuator fixed to one of said key and said mass member and abutting against the one to which said actuator is not affixed, said actuator is subjected to bending deformation to accumulate the elastic energy, and a bending movement acting on said actuator is large in the initial period of key depression and is smaller than the bending movement of the initial period of key depression during a later period of key depression and/or after key depression.

17. An apparatus according to claim 16, wherein bending rigidity of an abutting portion of said actuator in the initial period of key depression is smaller than the bending rigidity thereof during and/or after key depression.

18. An apparatus according to claim 16, wherein a sectional area of said abutting portion of said actuator in the initial period of key depression is smaller than the sectional area thereof during and/or after key depression.

19. An apparatus according to claim 16, wherein a modulus of elasticity of said abutting portion of said actuator is smaller than the modulus of elasticity thereof during and/or after key depression.

20. An apparatus according to claim 15, wherein said cushion mechanism comprises an actuator fixed to one of said key and said mass member and abutting against the one to which said actuator is not affixed, said actuator is elastically deformed to accumulate the elastic energy, and a modulus of elasticity of an abutting portion in the initial period of key depression is larger than the modulus of elasticity thereof during a later period of key depression and/or after key depression.

21. An apparatus according to claim 12, wherein said cushion mechanism is constituted by a plurality of projections arranged in a longitudinal direction of said key, and said plurality of projections sequentially abut against said key in accordance with pivoting motion of said key. projections arranged in a longitudinal direction of said key, and said plurality of projections sequentially abut against said key in accordance with pivoting motion of said key.

22. An apparatus according to claim 1, wherein said spring engages not only with said mass member but also with said key and comprises a single elastic member acting on both of said mass member and said key in a direction opposite to a pivoting direction of said key and said mass member upon depression of said key.

23. An apparatus according to claim 22, wherein the pivot fulcrums of said key and said mass member are provided on a frame, and said elastic member extends between the pivot fulcrum of said key and an end portion near the pivot fulcrum of said mass member.

24. An apparatus according to claim 23, wherein a stopper member having an elastic projecting portion projecting toward the pivot fulcrum of said key is arranged on said frame between the fulcrums of said key and said mass member, and during assembly of said key, said key engaged with the pivot fulcrum is pushed in a key depression direction while said projecting portion is elastically deformed, thereby preventing removal of said key from the pivot fulcrum.

25. An apparatus according to claim 24, wherein said stopper member is formed by outserting with respect to said frame.

26. An apparatus according to claim 23, wherein said stopper member has a second projecting portion projecting toward the pivot fulcrum of said mass member, and during assembly of said key, said mass member engaged with the pivot fulcrum is pushed in the key depression direction of said key while said second projecting portion is elastically deformed, thereby preventing removal of said mass member from the pivot fulcrum.

27. An apparatus according to claim 23, wherein said key comprises a hollow member, and a stopper member for regulating excessive elastic deformation of said elastic member is arranged on said frame between the fulcrum of said key and the pivot fulcrum of said mass member such that said stopper member is housed inside said hollow member of said key.

28. An apparatus according to claim 23, wherein a stopper member for regulating excessive elastic deformation of said elastic member is arranged on said frame between the fulcrum of said key and the pivot fulcrum of said mass member.

29. An apparatus according to claim 28, wherein said stopper member is arranged to be separated from said elastic member by a predetermined interval when said key is not depressed or depressed.

30. An apparatus according to claim 23, wherein said key has removal preventing means for preventing removal of said key from the pivot fulcrum.

31. An apparatus according to claim 30, wherein said removal preventing means comprises a groove which is formed in a proximal end portion or the pivot fulcrum of said key and in which an end of said elastic member is loosely inserted and a movement regulating portion which is formed in said elastic member and abuts against one end wall of said groove to regulate movement of said key in the longitudinal direction thereof.

32. An apparatus according to claim 23, wherein said elastic member partially engages with part of said key to urge said key against said pivot fulcrum, one end portion of said elastic member at a side of said pivot fulcrum of said key can be slidably moved in a groove formed at said pivot fulcrum, and a holding portion is formed at the other end portion of said elastic member extends in the longitudinal direction.

33. An apparatus according to claim 23, wherein said apparatus comprises removal preventing means for preventing removal of said mass member from the pivot fulcrum.

34. An apparatus according to claim 33, wherein said removal preventing means comprises a groove which is formed in the proximal end portion or the pivot fulcrum of said key and in which one end of said elastic member is loosely inserted and a movement regulating portion which is formed in said elastic member and abuts against one end wall of said groove to regulate movement of said key in the longitudinal direction thereof.

35. An apparatus according to claim 23, further comprising:

a stopper for regulating a pivot range of said mass member caused by spring bias;

a stopper engaging member which engages with said stopper of said mass member;

an actuator portion which receives a force from said key; and an end portion of said mass member to engage with said elastic member;

wherein said mass member is a metal member and a surface thereof is partially coated with a resin, and said stopper engaging member, said actuating portion, and said end portion of said mass member are formed of the resin coated on said metal member.

36. An apparatus according to claim 1, wherein said mass member is a metal member and a surface thereof is partially coated with a resin.

37. An apparatus according to claim 36, further comprising a stopper for regulating a pivot range of said mass member caused by spring bias;

wherein said mass member includes a stopper engaging portion which engages with said stopper and an actuator portion which receives a force from said key; and wherein said actuator portion and said stopper engaging portion are formed of the resin coated on said metal member.

38. An apparatus according to claim 37, further comprising:

a frame upon which the pivot fulcrums of said key and said mass member are provided; and a guide portion on said mass member formed of the resin coated on the metal member so that if said mass member is brought into contact with said frame upon key depression, the frame contacts the resin of said guide portion rather than a metal body portion of said mass member.

39. An apparatus according to claim 37, wherein an insertion guide portion of said mass member for guiding insertion into a space formed in a frame during assembly is formed of the resin coated on said metal member.

40. An apparatus according to claim 36, further comprising a switch drive portion provided to said mass member, a touch response switch provided in association with said switch drive portion, and a control circuit, controlled in accordance with an operation of said switch, for controlling production of a musical tone, and wherein when said mass member is pivoted in accordance with a key depression operation of said key, said switch drive portion operates said switch to control said control circuit, and at least an end portion of said mass member which engages with the pivot fulcrum of said mass member, an actuator portion which receives a force from said key, and said drive portion are formed of the resin coated on said metal member.

41. An apparatus according to claim 1, wherein a weight is embedded in said mass member.

42. An apparatus according to claim 1, further comprising cushion means for reducing an impact force produced when said mass member strikes against said key during returning of said mass member to the initial state by a spring biasing force upon releasing of said key.

43. An apparatus according to claim 42, wherein said cushion means has projecting pieces projecting downward from a lower surface of said key such that an interval therebetween is gradually increased downward, and said mass member partially abuts against inner walls of said projecting pieces.

44. An apparatus according to claim 43, wherein said projecting pieces are disposed in the longitudinal direction of said key by a plurality of pairs.

45. An apparatus according to claim 43, wherein each of said projecting pieces is formed of a material having a modulus of elasticity smaller than the modulus of elasticity of said key.

46. An apparatus according to claim 43, wherein small pieces shorter than said projecting pieces are arranged between said projecting pieces.

47. An apparatus according to claim 1, wherein regulating means for regulating movement of said key in a transverse direction thereof is provided at the front side of said key.

48. An apparatus according to claim 47, wherein said regulating means is constituted by a stopper extending vertically along both side walls of said key.

49. An apparatus according to claim 1, wherein said key has a projection projecting downward, the pivot fulcrums of said key and said mass member are provided on a frame, and a member removal preventing portion is provided to abut against said projection, said member removal preventing portion being supported by said frame, so that said projection engages with said member removal preventing portion when said key is moved in a direction apart from the pivot fulcrum, thereby preventing removal of said key or said mass member from the pivot fulcrum.

50. An apparatus according to claim 49, wherein said member removal preventing portion is provided to said mass member.

51. An apparatus according to claim 50, wherein said member removal preventing portion is provided to an actuator portion of said mass member.

52. A keyboard apparatus of an electronic musical instrument, comprising:

a plurality of keys, each of which pivots about a first pivot fulcrum;

a plurality of weight members corresponding to said keys respectively, each of which pivots about a second pivot fulcrum in cooperation with the corresponding key to provide the corresponding key with inertia of the weight member when the corresponding key is depressed; and a plurality of biasing means corresponding to said keys respectively, each of which is constituted by a common spring member which biases said corresponding weight member and said corresponding key to initial states.

53. A keyboard apparatus according to claim 52, wherein each of said weight members comprising a longitudinal member is positioned below each of the corresponding keys and disposed along each of the corresponding keys.

54. A keyboard apparatus of an electronic musical instrument, comprising:

a plurality of keys, each of which pivots about a first pivot fulcrum, each key including side walls;

a plurality of weight members corresponding to said keys respectively, each of which pivots about a second pivot fulcrum in cooperation with the corresponding key to provide the corresponding key with inertia of the weight member when the corresponding key is depressed; and a plurality of biasing means corresponding to said keys respectively, each of which is constituted by a single spring member which biases said corresponding key and a weight member corresponding to said key to initial states;

each of said weight members and each of said biasing means being positioned between the inner side walls of the corresponding key.

55. A keyboard apparatus according to claim 54, wherein said single spring means is disposed between said corresponding weight member and a rear end portion of said corresponding key.

56. A keyboard apparatus of an electronic musical instrument, comprising:

a plurality of keys, each of which pivots about a first pivot fulcrum;

a plurality of weight members corresponding to said keys respectively, each of which pivots about a second pivot fulcrum in cooperation with the corresponding key to provide the corresponding key with inertia of the weight member when the corresponding key is depressed; and a plurality of biasing means corresponding to said keys respectively, each of which is constituted by a single spring member which biases said corresponding key to an initial state, each of the weight members comprising first, second and third portions, said first portion being pivoted about said second fulcrum and extending substantially in a horizontal direction, said second portion extending downwardly from said first portion, the third portion further extending substantially horizontally from said second portion and along the corresponding key.

* * * * *